US006273806B1

(12) United States Patent
Bennett et al.

(10) Patent No.: US 6,273,806 B1
(45) **Date of Patent: *Aug. 14, 2001**

(54) POLISHING PAD HAVING A GROOVED PATTERN FOR USE IN A CHEMICAL MECHANICAL POLISHING APPARATUS

(75) Inventors: Doyle E. Bennett, Santa Clara; Fred C. Redeker, Fremont; Thomas H. Osterheld, Mountain View; Ginnetto Addiego, Berkeley, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/350,754

(22) Filed: Jul. 9, 1999

Related U.S. Application Data

(63) Continuation-in-part of application No. 09/003,315, filed on Jan. 6, 1998, now Pat. No. 5,984,769, which is a continuation-in-part of application No. 08/856,948, filed on May 15, 1997, now Pat. No. 5,921,855.

(51) Int. Cl.[7] ..... B24D 11/00
(52) U.S. Cl. ..... 451/527; 451/529; 451/550
(58) Field of Search ..... 451/527, 529, 451/533, 539, 550

(56) References Cited

U.S. PATENT DOCUMENTS

| | | | |
|---|---|---|---|
| 5,020,283 | 6/1991 | Tuttle . | |
| 5,131,190 | 7/1992 | Gougouyan . | |
| 5,177,908 | 1/1993 | Tuttle . | |
| 5,216,843 | 6/1993 | Breivogel et al. . | |
| 5,297,364 | 3/1994 | Tuttle . | |
| 5,329,734 | 7/1994 | Yu . | |
| 5,394,655 | 3/1995 | Allen et al. | 451/63 |
| 5,421,769 | 6/1995 | Schultz et al. | 451/41 |
| 5,489,233 | 2/1996 | Cook et al. | 451/41 |
| 5,527,215 | 6/1996 | Rubino et al. | 451/527 |
| 5,558,563 | 9/1996 | Cote et al. | 451/41 |
| 5,578,362 | 11/1996 | Reinhardt et al. | 428/147 |
| 5,645,469 | 7/1997 | Burke et al. | 451/41 |
| 5,650,039 | 7/1997 | Talieh | 156/636.1 |
| 5,888,121 | 3/1999 | Kirchner et al. | 451/41 |
| 5,921,855 | 7/1999 | Osterheld et al. | 451/527 |
| 5,984,769 | 11/1999 | Bennett et al. | 451/527 |
| B1 5,190,568 | 3/1996 | Tselesin . | |

FOREIGN PATENT DOCUMENTS 9-011119 1/1997 (JP) .

*Primary Examiner*—Timothy V. Eley
(74) *Attorney, Agent, or Firm*—Fish & Richardson

(57) ABSTRACT

A polishing pad for a chemical mechanical polishing apparatus. The polishing pad includes a plurality of circular concentric grooves. The polishing pad may include multiple regions with grooves of different widths and spacings.

16 Claims, 20 Drawing Sheets

POLISHING PAD HAVING A GROOVED PATTERN FOR USE IN A CHEMICAL MECHANICAL POLISHING APPARATUS

CROSS-REFERENCE TO RELATED APPLICATIONS

This application is a continuation-in-part of U.S. application Ser. No. 09/003,315, filed Jan. 6, 1998 now U.S. Pat. No. 5,984,769, which is a continuation-in-part of U.S. application Ser. No. 08/856,948, filed May 15, 1997 now U.S. Pat. No. 5,921,855, the entire disclosures of which are incorporated herein by reference.

BACKGROUND

The present invention relates generally to chemical mechanical polishing of substrates, and more particularly to a polishing pad having a grooved pattern for a chemical mechanical polishing apparatus.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. Therefore, there is a need to periodically planarize the substrate surface to provide a flat surface.

Chemical mechanical polishing (CMP) is one accepted method of planarization. This method typically requires that the substrate be mounted on a carrier or polishing head. The exposed surface of the substrate is then placed against a rotating polishing pad. The carrier head provides a controllable load, i.e., pressure, on the substrate to push it against the polishing pad. In addition, the carrier head may rotate to provide additional motion between the substrate and polishing surface.

A polishing slurry, including an abrasive and at least one chemically-reactive agent, may be supplied to the polishing pad to provide an abrasive chemical solution at the interface between the pad and the substrate. CMP is a fairly complex process, and it differs from simple wet sanding. In a CMP process, the reactive agent in the slurry reacts with the outer surface of the substrate to form reactive sites. The interaction of the polishing pad and abrasive particles with the reactive sites on the substrate results in polishing of the substrate.

An effective CMP process not only provides a high polishing rate, it also provides a substrate surface which is finished (lacking small-scale roughness) and flat (lacking large-scale topography). The polishing rate, finish and flatness are determined by the pad and slurry combination, the relative speed between the substrate and pad, and the force pressing the substrate against the pad. The polishing rate sets the time needed to polish a layer. Because inadequate flatness and finish can create defective substrates, the selection of a polishing pad and slurry combination is usually dictated by the required finish and flatness. Given these constraints, the polishing time needed to achieve the required finish and flatness sets the maximum throughput and slurry consumption of the CMP apparatus.

A recurring problem in CMP is non-uniformity of the polishing rate across the surface of the substrate. One source of this non-uniformity is the so-called "edge-effect", i.e., the tendency for the substrate edge to be polished at a different rate than the center of the substrate. Another source of non-uniformity is termed the "center slow effect", which is the tendency of center of the substrate to be under-polished. These non-uniform polishing effects reduce the overall flatness of the substrate and the substrate area suitable for integrated circuit fabrication, thus decreasing the process yield.

Another problem relates to slurry distribution. As indicated above, the CMP process is fairly complex, requiring the interaction of the polishing pad, abrasive particles and reactive agent with the substrate to obtain the desired polishing results. Accordingly, ineffective/insufficient slurry distribution across the polishing pad surface provides less than optimal or unsatisfactory polishing results. Polishing pads used in the past have included perforations about the pad. These perforations by themselves, when filled, distribute slurry in their respective local regions as the polishing pad is compressed. This method of slurry distribution has limited effectiveness, since each perforation in effect acts independently. Thus, some of the perforations may have too little slurry, while others may have too much slurry. Furthermore, there is no way to directly channel the excess slurry to where it is most needed, where only perforations are employed on the polishing pad.

Another problem is "glazing" of the polishing pad. Glazing occurs when the polishing pad is heated and compressed in regions where the substrate is pressed against the pad. The peaks of the polishing pad are pressed down and the pits are filled up. In that case, the polishing pad surface becomes smoother and less abrasive, thus increasing the polishing time. Therefore, the polishing pad surface must be periodically returned to an abrasive condition, or "conditioned", to maintain a high throughput.

In addition, during the conditioning process, waste materials produced by conditioning the pad may fill or clog the perforations in the pad. Perforations clogged with such waste materials may not hold slurry effectively, thereby reducing the effectiveness of the polishing process.

An additional problem associated with filled or clogged pad perforations relates to the separation of the polishing pad from the substrate after polishing has been completed. The polishing process produces a high degree of surface tension between the pad and the substrate. The perforations decrease the surface tension by reducing the contact area between the pad and the substrate. However, as the perforations become filled or clogged with waste material, the surface tension increases, making it more difficult to separate the pad and the substrate. As such, the substrate is more likely to be damaged during the separation process.

Yet another problem in CMP is referred to as the "planarizing effect". Ideally, a polishing pad only polishes peaks in the topography of the substrate. After a certain period of polishing, the areas of these peaks will eventually be level with the valleys, resulting in a substantially planar surface. However, where a substrate is subjected to the "planarizing effect", the peaks and valleys will be polished simultaneously. The "planarizing effect" results from the compressible nature of the polishing pad in response to point loading. In particular, where the polishing pad is too flexible, it will deform and contact a large surface area of the substrate, including both the peaks and the valleys in the substrate surface.

Another problem is the over-polishing of the outermost concentric region of a substrate, particularly where an oxide layer of the substrate is polished with a colloidal slurry. In other words, the outermost region of the substrates receives a fast polish (or edge-fast polish) and the central region receives a relatively slower polish (or center-slow polish), resulting in a polishing ring in the outermost concentric region.

Another problem is where the deposited layer film is non-uniform. In particular, where metal films (such as copper) are deposited on the substrate, the film thickness may be thinner in the outermost concentric edge area of the substrate. Hence, there exists a need to polish the outermost edge area of the substrate at a slower rate than the center area of the substrate to compensate for the non-uniform film thickness of the film layer, such as a copper film layer.

Accordingly, it would be useful to provide a CMP apparatus which ameliorates some or all of these problems.

SUMMARY

In one aspect, the invention is directed to a polishing pad for polishing a substrate in a chemical mechanical polishing system. The polishing pad has a first polishing region having a first plurality of substantially circular concentric grooves with a first width and a first pitch, and a second polishing region surrounding the first polishing region and having a second plurality of substantially circular concentric grooves with a second width and a second pitch. The second polishing region is an outermost region of the polishing pad. The second width is greater than the first width.

Implementations of the invention may include one or more of the following features. The second pitch may be less or substantially equal to the first pitch. A first plurality of partitions may separate the first plurality of grooves, and a second plurality of partitions may separate the second plurality of grooves. A ratio of the surface area of the first plurality of partitions to the surface area of the first polishing region may be greater than a ratio of the surface area of the second plurality of partitions to the surface area of the second polishing region.

In another aspect, the invention is directed to a polishing pad for polishing a substrate in a chemical mechanical polishing system. The polishing pad has a first polishing region having a first plurality of substantially circular concentric grooves with a first width and a first pitch, and a second polishing region surrounding the first polishing region and having a second plurality of substantially circular concentric grooves with a second width and a second pitch. The second polishing region is an outermost concentric region of the polishing pad. The second pitch is less than the first pitch.

Implementations of the invention may include one or more of the following features. The second width may be greater than or substantially equal to the first width. A first plurality of partitions may separate the first plurality of grooves, and a second plurality of partitions may separate the second plurality of grooves. A ratio of the surface area of the first plurality of partitions to the surface area of the first polishing region may be greater than a ratio of the surface area of the second plurality of partitions to the surface area of the second polishing region.

In another aspect, the invention is directed to a polishing pad for polishing a substrate in a chemical mechanical polishing system. The polishing pad has a first polishing region having a first plurality of substantially circular concentric grooves with a first width and a first pitch, a second polishing region surrounding the second polishing region and having a second plurality of substantially circular concentric grooves with a second width and a second pitch, and a third polishing region surrounding the second polishing region and having a third plurality of substantially circular concentric grooves with a third width and a third pitch. The first width is greater than the second width or the first pitch is less than the second pitch, and the third pitch and width are substantially equal to the first pitch and width, respectively.

Implementations of the invention may include one or more of the following features. The first pitch may be less than the second pitch. A first plurality of partitions may separate the first plurality of grooves, a second plurality of partitions may separate the second plurality of grooves, and a third plurality of partitions may separate the third plurality of grooves. A first ratio of the surface area of the first plurality of partitions to the surface area of the first region may be in the range of about 0.5 to 0.75, a second ratio of the surface area of the second plurality of partitions to the surface area of the second region may be in the range of about 0.75 to 0.95, and a third ratio of the surface area of the third plurality of partitions to the surface area of the third region may be in the range of about 0.50 to 0.75. The first and third ratios may be about 0.69, and the second ratio may be about 0.83. The first, second and third pluralities of grooves may each have a depth in the range of about 0.02 to 0.03 inches. A ratio of the first width to the second width may be in the range of about 2:1 to 20:1, e.g., approximately 6:1.

In another aspect, the invention is directed to a polishing pad for polishing a substrate in a chemical mechanical polishing system. The pad has a first polishing region having a first plurality of circular grooves, and a second polishing region having a second plurality of circular grooves and a plurality of perforations interspersed with the second plurality of circular grooves.

Implementations of the invention may include one or more of the following features. The first polishing region may surround or be surrounded by the second polishing region. A third polishing region may having a third plurality of circular grooves, and a fourth polishing region may be formed without grooves or perforations. The third polishing region may surround the fourth polishing region, and the second polishing region may surround the third polishing region.

In another aspect, the invention is directed to a polishing pad for polishing a substrate in a chemical mechanical polishing system. The polishing pad has a first polishing region that lacks grooves, a second polishing region surrounding the second polishing region and having a plurality of substantially circular concentric grooves, and a third polishing region that lacks grooves surrounding the second polishing region.

In another aspect, the invention is directed to a method of polishing. In the method, a substrate is positioned against a polishing pad that includes a first polishing region that lacks grooves, a second polishing region surrounding the second polishing region and having a plurality of substantially circular concentric grooves, and a third polishing region that lacks grooves surrounding the second polishing region. An inner edge of the substrate overlies the first polishing region, a central portion of the substrate overlies the second polishing region, and an outer edge of the substrate overlies the third polishing region. The polishing pad is rotated.

The invention advantageously eliminates or substantially reduces polishing rings on a substrate polished by a CMP apparatus. The invention also advantageously polishes the inner region of the substrate at a faster rate than in the outer region to planarize a substrate having a relatively thinner layer in the outer region. Still further, the invention advantageously combines grooves and perforations on a polishing pad to attenuate the polishing rate and to eliminate or substantially reduce the occurrence of polishing rings. Other features and advantages will be apparent from the following description, including the drawings and claims.

DETAILED DESCRIPTION

Figure 1:
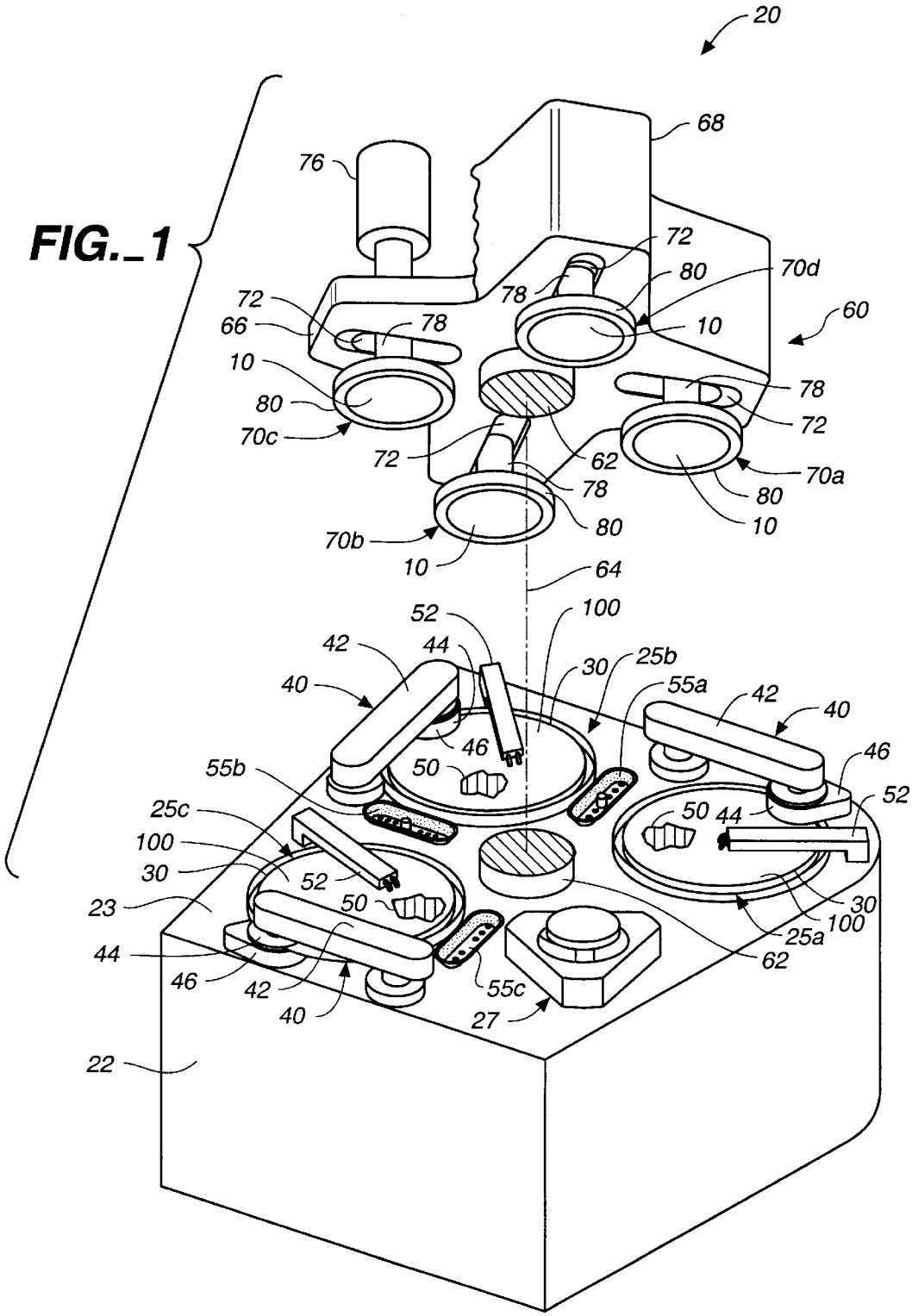
FIG. 1 is a schematic exploded perspective view of a chemical mechanical polishing apparatus.

Referring to FIG. 1, one or more substrates 10 are polished by a chemical mechanical polishing apparatus 20. A complete description of the polishing apparatus 20 is found in U.S. patent application Ser. No. 08/549,336, entitled RADIALLY OSCILLATING CAROUSEL PROCESSING SYSTEM FOR CHEMICAL MECHANICAL POLISHING, filed Oct. 27, 1995 by Ilya Perlov, et al., and assigned to the assignee of the present invention, the entire disclosure of which is incorporated herein by reference.

The polishing apparatus 20 includes a lower machine base 22 including a table top 23 mounted thereon and a removable outer cover (not shown). The table top 23 supports a series of polishing stations 25*a*, 25*b*, 25*c* and a transfer station 27. The transfer station 27 forms a generally square arrangement with the three polishing stations 25*a*,25*b*,25*c*. The transfer station 27 serves multiple functions, including receiving individual substrates 10 from a loading apparatus (not shown), washing the substrates, loading the substrates into carrier heads (to be described below), receiving the substrates from the carrier heads, washing the substrates again, and transferring the substrates back to the loading apparatus.

Each polishing station 25*a*,25*b*,25*c* includes a rotatable platen 30 on which is placed a polishing pad 100. Where the substrate 10 is an "eight-inch" (200 millimeter) or "twelve-inch" (300 millimeter) diameter disk, the platen 30 and the polishing pad 100 will be about twenty inches in diameter. The platen 30 may be a rotatable aluminum or stainless steel plate connected to a platen drive motor (not shown). For most polishing processes, the platen drive motor rotates platen 30 at thirty to two hundred revolutions per minute, although lower or higher rotational speeds may be used.

Each polishing station 25*a*,25*b*,25*c* may further include an associated pad conditioner apparatus 40. Each pad conditioner apparatus 40 has a rotatable arm 42 holding an independently-rotating conditioner head 44 and an associated washing basin 46. The conditioner apparatus 40 maintains the condition of the polishing pad 100 so it will effectively polish any substrate pressed against it while it is rotating.

A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing) is supplied to the surface of the polishing pad 100 by a combined slurry/rinse arm 52. The slurry/rinse arm 52 may include two or more slurry supply tubes to provide slurry to the surface of the polishing pad 100. Sufficient slurry is provided to cover and wet the entire polishing pad 100. The slurry/rinse arm 52 also includes several spray nozzles (not shown) which provide a high-pressure rinse of the polishing pad 100 at the end of each polishing and conditioning cycle.

Two or more intermediate washing stations 55*a*, 55*b* may be positioned between the neighboring polishing stations 25*a*,25*b*,25*c*. The washing stations rinse the substrates as they pass from one polishing station to another.

A rotatable multi-head carousel 60 is positioned above a lower machine base 22. The carousel 60 is supported by a center post 62 and is rotated thereon about a carousel axis 64 by a carousel motor assembly located within the base 22. The center post 62 supports a carousel support plate 66 and a cover 68. The carousel 60 includes four carrier head systems 70*a*, 70*b*, 70*c*, and 70*d*. Three of the carrier head systems receive and hold substrates, and polish them by pressing them against the polishing pads 100 on the platens 30 of the polishing stations 25*a*,25*b*,25*c*. One of the carrier head systems 70*a*,70*b*,70*c*,70*d* receives a substrate from and delivers a substrate to transfer station 27.

The four carrier head systems 70*a*,70*b*,70*c*,70*d* are mounted on carousel support plate 66 at equal angular intervals about carousel axis 64. Center post 62 allows the carousel motor to rotate carousel support plate 66 and to orbit carrier head systems 70*a*,70*b*,70*c*,70*d* and the substrates attached thereto about carousel axis 64.

Each carrier head system 70*a*,70*b*,70*c*,70*d* includes a carrier head 80. Each carrier head 80 independently rotates about its own axis. A carrier drive shaft 74 connects a carrier head rotation motor 76 (shown by the removal of one quarter of cover 68) to carrier head 80. There is one carrier drive shaft and motor for each head. In addition, each carrier head 80 independently laterally or radially oscillates in a radial slot 72 formed in carousel support plate 66. A slider (not shown) supports each drive shaft 74 in the radial slot 72. A radial drive motor (not shown) may move the slider to laterally oscillate the carrier head.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

Figure 2:
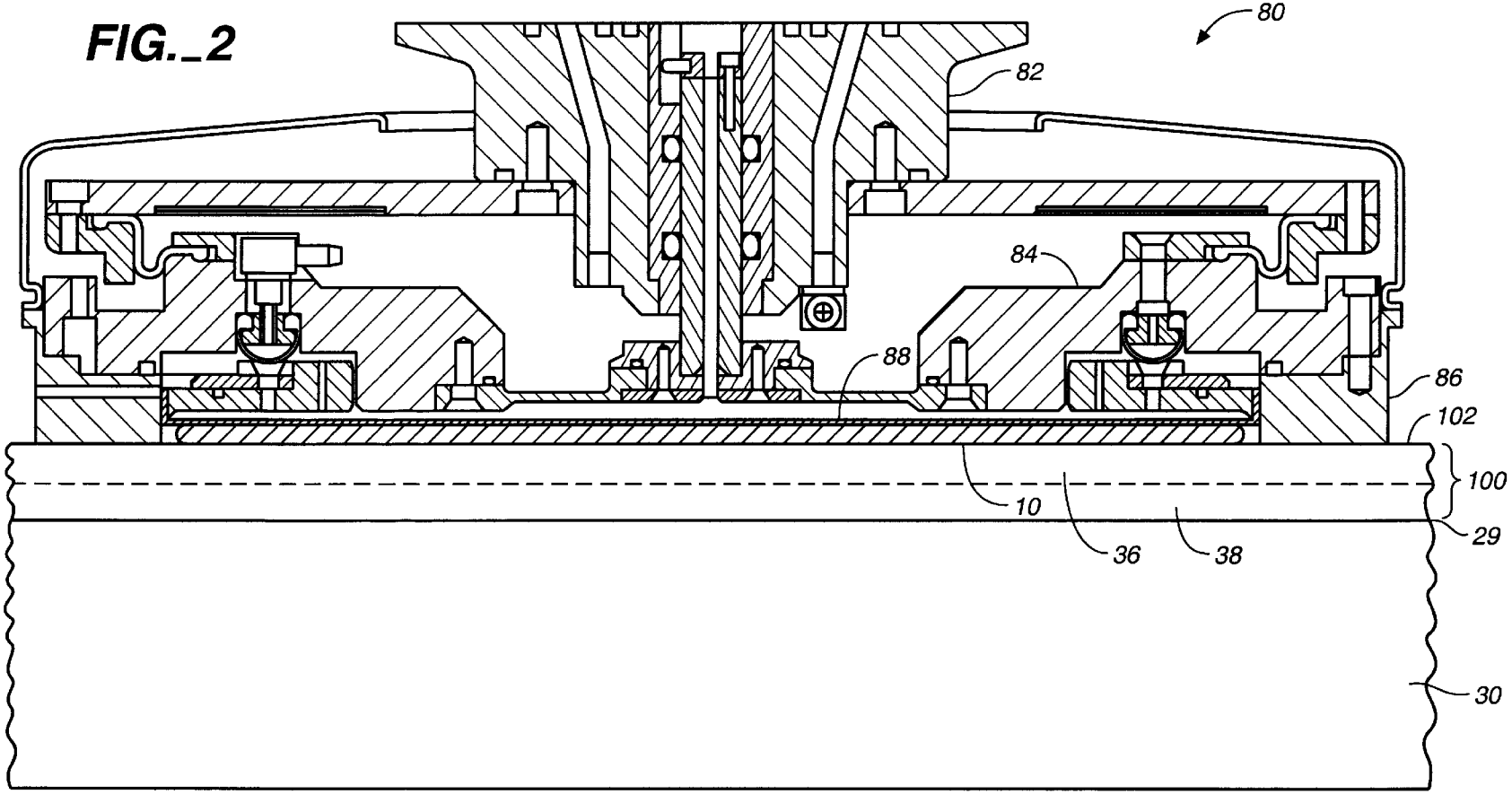
FIG. 2 is a schematic cross-sectional view of a carrier head and a polishing pad.

Referring to FIG. 2, each carrier head 80 includes a housing assembly 82, a base assembly 84 and a retaining ring assembly 86. A loading mechanism may connect the base assembly 84 to the housing assembly 82. The base assembly 84 may include a flexible membrane 88 which provides a substrate receiving surface for the carrier head. A description of carrier head 80 may be found in U.S. patent application Ser. No. 08/745,679, entitled A CARRIER HEAD WITH A FLEXIBLE MEMBRANE FOR A CHEMICAL MECHANICAL POLISHING SYSTEM, filed Nov. 8, 1996, by Steven M. Zuniga et al., assigned to the assignee of the present invention, the entire disclosure of which is incorporated herein by reference.

The polishing pad 100 may comprise a composite material having a roughened polishing surface 102. The polishing pad 100 may have an upper layer 36 and a lower layer 38. The lower layer 38 may be attached to the platen 30 by a pressure-sensitive adhesive layer 39. The upper layer 36 may be harder than the lower layer 38. The upper layer 36 may be composed of a polyurethane or a polyurethane mixed with a filler. The lower layer 38 may be composed of compressed felt fibers leached with a urethane. A two-layer polishing pad, with the upper layer composed of IC-1000 and the lower layer composed of SUBA-4, is available from Rodel, Inc. of Newark, Del. (IC-1000 and SUBA-4 are product names of Rodel, Inc.).

Figure 3:
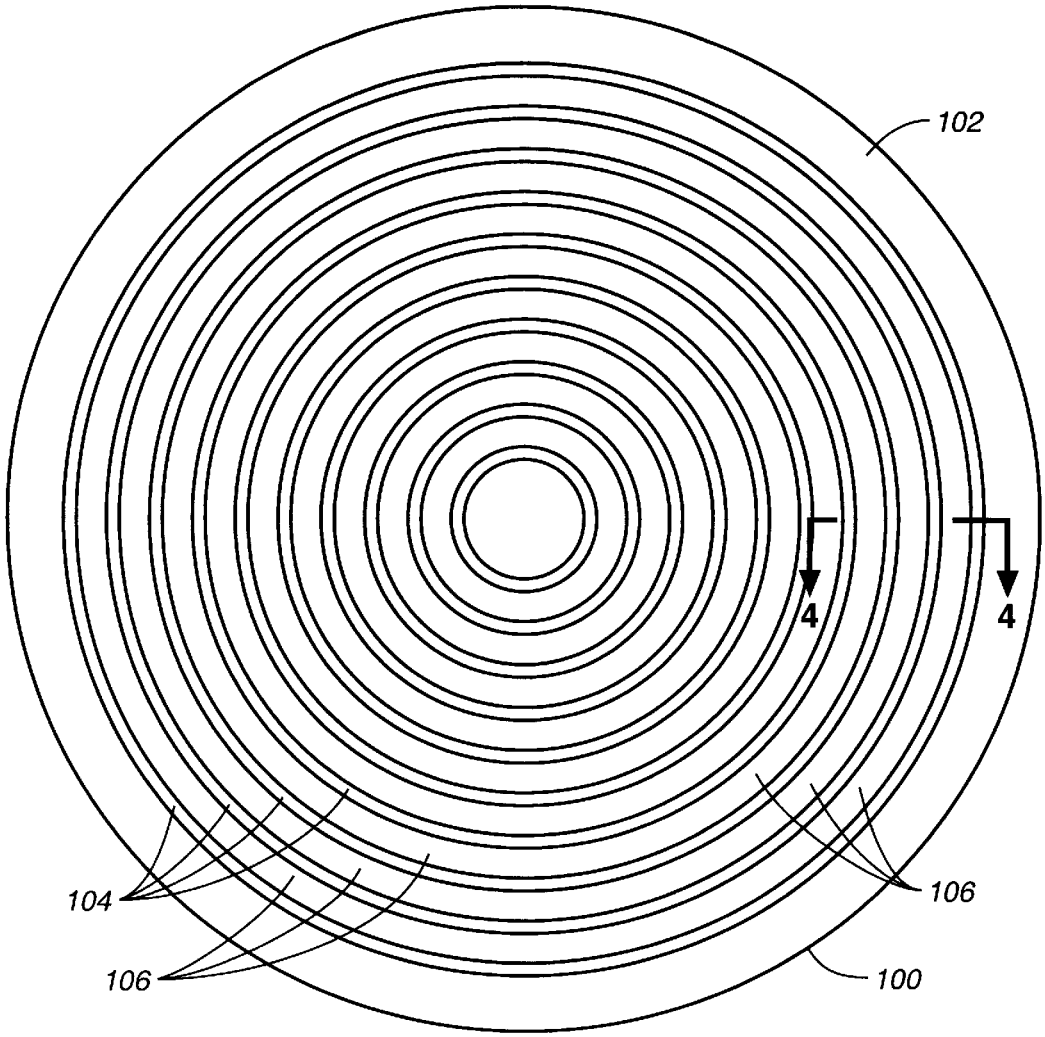
FIG. 3 is a schematic top view of a polishing pad having concentric circular grooves.
Figure 4:
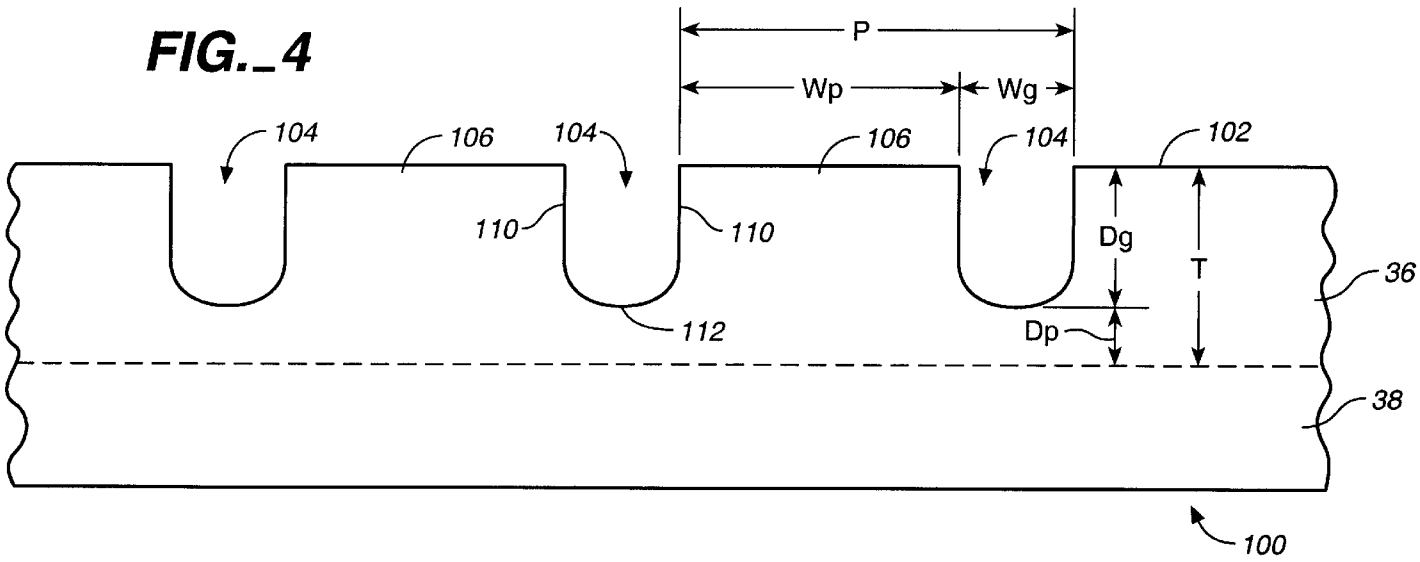
FIG. 4 is a schematic cross-sectional view of the polishing pad of FIG. 3 along line 4—4.

Referring to FIGS. 3 and 4, a plurality of concentric circular grooves 104 are disposed in the polishing surface 102 of the polishing pad 100. Advantageously, these grooves are uniformly spaced with a pitch P. The pitch P, as shown mostly clearly by FIG. 4, is the radial distance between adjacent grooves. Between each groove is an annular partition 106 having a width $W_p$. Each groove 104 includes walls 110 which terminate in a substantially U-shaped base portion 112. Each groove may have a depth $D_g$ and a width $W_g$. Alternately, the grooves may have a rectangular cross-section.

The walls 110 may be generally perpendicular and terminate at U-shaped base 112. Each polishing cycle results in wear of the polishing pad, generally in the form of thinning of the polishing pad as polishing surface 102 is worn down. The width $W_g$ of a groove with substantially perpendicular walls 110 does not change as the polishing pad is worn. Thus, the generally perpendicular walls ensure that the polishing pad has a substantially uniform surface area over its operating lifetime.

The various embodiments of the polishing pad include wide and deep grooves in comparison to those used in the past. The grooves 104 have a minimum width $W_g$ of about 0.015 inches. Each groove 104 may have a width $W_g$ between about 0.015 and 0.04 inches. Specifically, the grooves may have a width $W_g$ of approximately 0.020 inches. Each partition 106 may have a width $W_p$ between about 0.075 and 0.20 inches. Specifically, the partitions may have a width Wp of approximately 0.10 inches. Accordingly, the pitch P between the grooves may be between about 0.09 and 0.24 inches. Specifically, the pitch may be approximately 0.12 inches.

The ratio of groove width $W_g$ to partition width $W_p$ may be selected to be between about 0.10 and 0.25. The ratio may be approximately 0.2. Where the grooves are too wide, the polishing pad will be too flexible, and the "planarizing effect" will occur. On the other hand, where the grooves are too narrow, it becomes difficult to remove waste material from the grooves. Similarly, where the pitch is too small, the grooves will be too close together and the polishing pad will be too flexible. On the other hand, where the pitch is too large, slurry will not be evenly transported to the entire surface of the substrate.

The grooves 104 also have a depth $D_g$ of at least about 0.02 inches. The depth $D_g$ may be between about 0.02 and 0.05 inches. Specifically, the depth $D_g$ of the grooves may be approximately 0.03 inches. Upper layer 36 may have a thickness T between about 0.06 and 0.12 inches. As such, the thickness T may be about 0.07 inches. The thickness T should be selected so that the distance DP between the bottom of base portion 112 and lower layer 38 is between about 0.035 and 0.085 inches. Specifically, the distance $D_p$ may be about 0.04 inches. Where the distance $D_p$ is too small, the polishing pad will be too flexible. On the other hand, where the distance $D_p$ is too large, the polishing pad will be thick and, consequently, more expensive. Other embodiments of the polishing pad may have grooves with a similar depth.

Referring to FIG. 3, the grooves 104 form a pattern defining a plurality of annular islands or projections. The surface area presented by these islands for polishing is between about 90% and 75% of the cross-sectional surface area of the polishing pad 100. As a result, the surface tension between the substrate and the polishing pad is reduced, facilitating separation of the polishing pad from the substrate at the completion of a polishing cycle.

Figure 5:
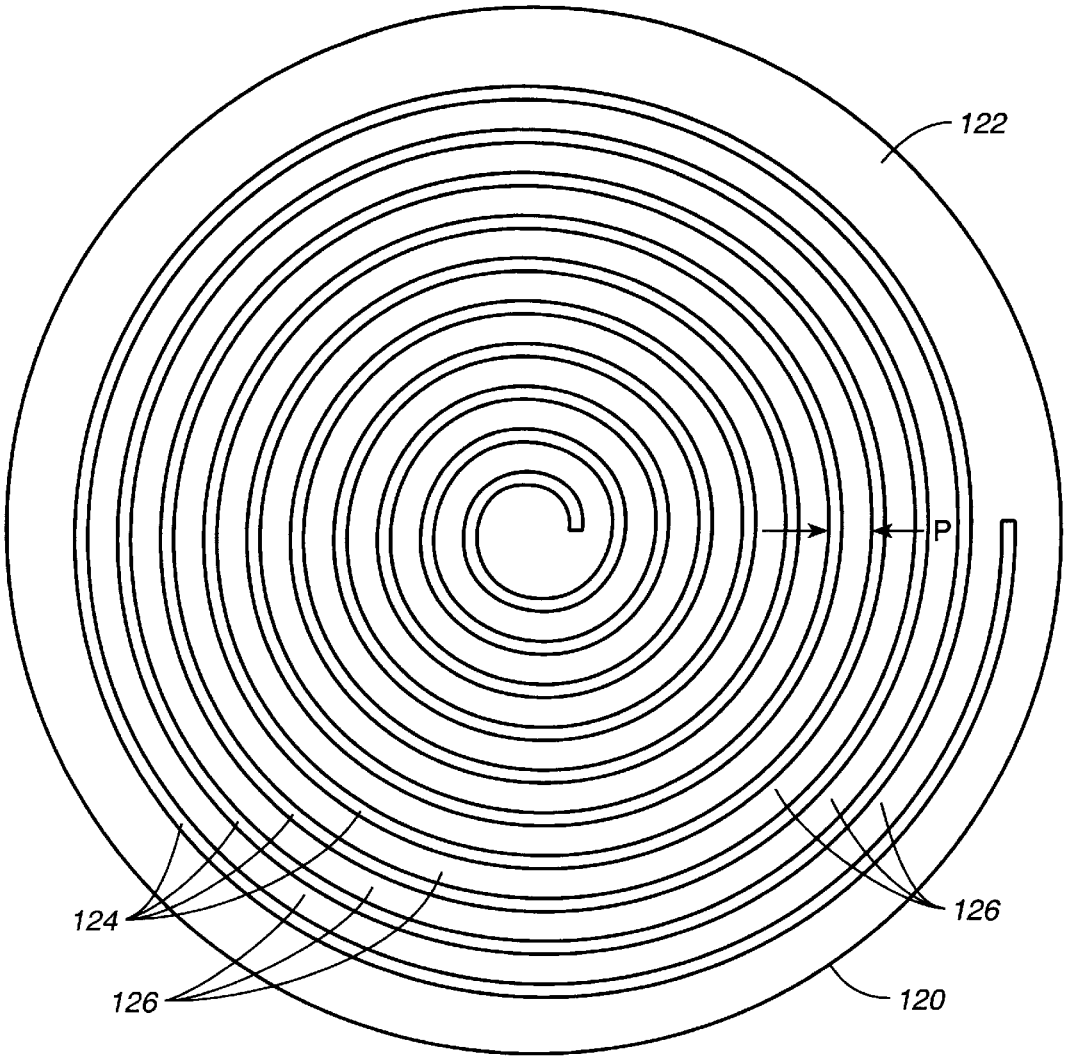
FIG. 5 is a schematic top view of a polishing pad using a spiral groove.

Referring to FIG. 5, in another embodiment, a spiral groove 124 is disposed in a polishing surface 122 of a polishing pad 120. Advantageously, the groove is uniformly spaced with a pitch P. A spiral partition 126 separates the rings of the spiral. The spiral groove 124 and the spiral partition 126 may have the same dimensions as the circular groove 104 and the circular partition 106 of FIG. 3. That is, the spiral groove 124 may have depth of at least about 0.02 inches, a width of at least about 0.015 inches, and a pitch of at least about 0.09 inches. Specifically, the spiral groove 124 may have a depth between 0.02 and 0.05 inches, such as 0.03 inches, a width between about 0.015 and 0.40 inches, such as 0.20 inches, and a pitch P between about 0.09 and 0.24 inches, such as 0.12 inches.

Figure 7:
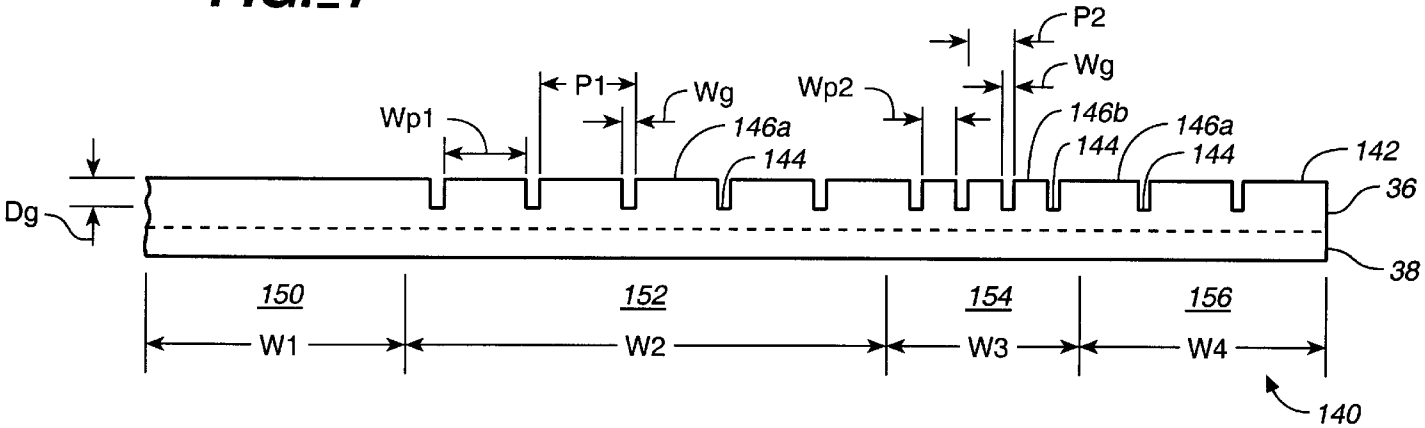
FIG. 7 is a cross-sectional view of the polishing pad of FIG. 6 along line 7—7.
Figure 6:
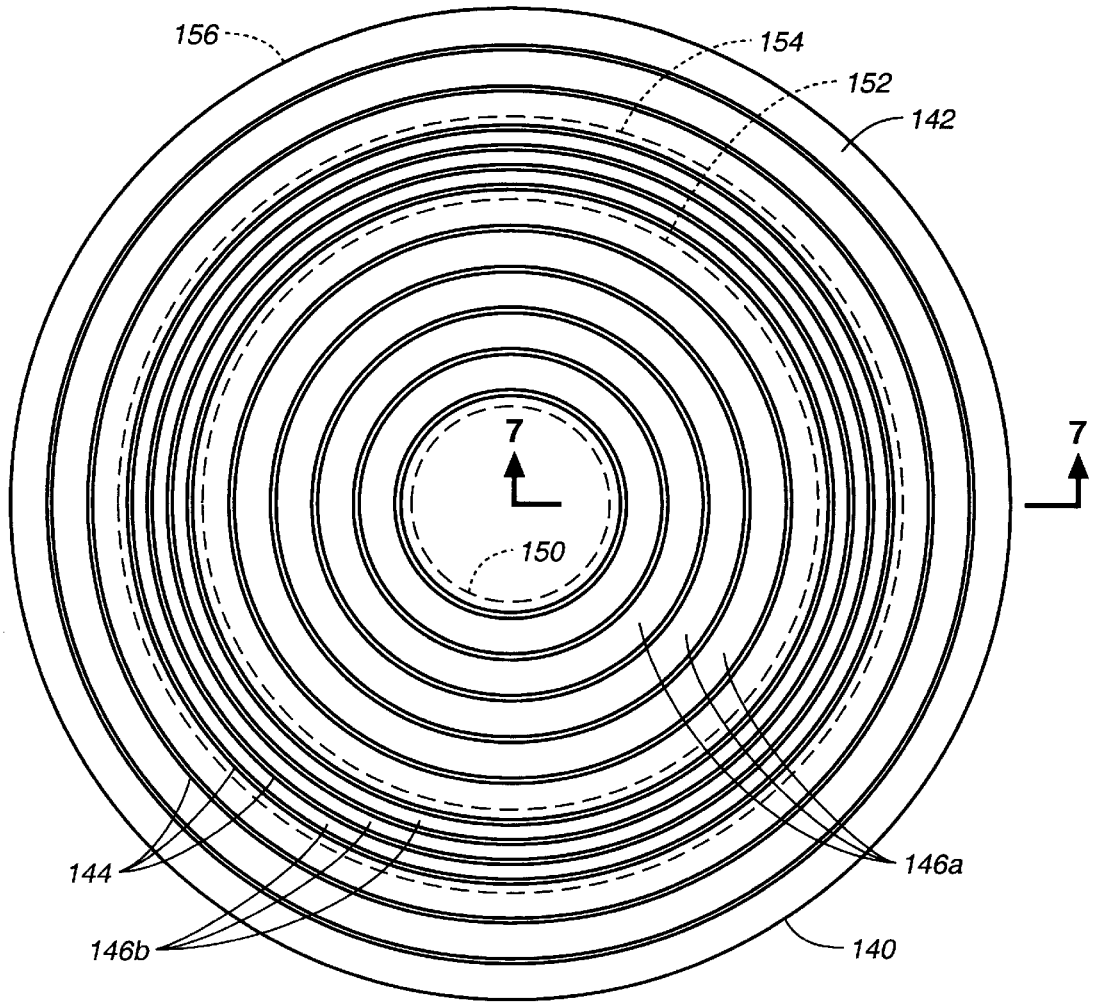
FIG. 6 is a schematic top view of a polishing pad having regions of different groove spacing.

Referring to FIGS. 6 and 7, in another embodiment, a plurality of concentric circular grooves 144 are disposed in a polishing surface 142 of a polishing pad 140. However, these grooves are not uniformly spaced. Rather, polishing surface 142 is partitioned into regions in which the grooves are spaced apart with different pitches. In addition, the grooves do not necessarily have a uniform depth.

In one implementation, polishing surface 142 is divided into four concentric regions including an innermost region 150, an annular outermost region 156 and two intermediate regions 152,154. Region 150 may be constructed without grooves, and the grooves in region 154 may be more closely spaced than the grooves in regions 152,156. Thus, the grooves in the region 154 are spaced apart with a pitch $P_2$, whereas the grooves in regions 152 and 156 are spaced apart with a pitch $P_1$, where $P_2$ is less than $P_1$. Each groove 144 may have a width $W_g$. The width $W_g$ may be between about 0.015 and 0.04 inches, such as about 0.02 inches. The grooves may also have a uniform depth $D_g$ of between about 0.02 and 0.03 inches.

Between each groove in wide-pitch regions 152 and 156 is a wide annular partition 146*a* having a width $W_{P1}$, whereas between each groove in narrow-pitch region 154 is an narrow annular partition 146*b* having a width $W_{P2}$. Each wide partition 146*a* may have a width $W_{P1}$ between about 0.12 and 0.24 inches, such as about 0.18 inches. Accordingly, the pitch $P_2$ between the grooves in the wide partition regions may be between about 0.09 and 0.24 inches, such as 0.2 inches. Thus, pitch $P_1$ may be about twice as large as pitch $P_2$. The surface area presented by wide partitions 146*a* is about 90% of the available cross-sectional surface area of the wide partition regions.

As previously noted, the grooves in region 154 may be spaced closer together. Each narrow partition 146*b* may have a width $W_{P2}$ between about 0.04 and 0.12 inches, such as about 0.08 inches. Accordingly, the pitch $P_2$ between the grooves in the narrow partition region may be between about 0.045 and 0.2 inches, such as 0.10 inches. The surface area presented by narrow partitions 146*b* is about 75% of the available cross-sectional surface area of the narrow partition region.

Polishing pad 140 is particularly suited to reduce polishing uniformity problems, such as the so-called "fast band" effect. The fast band effect tends to appear in oxide polishing using a two-layer polishing pad with an SS12 slurry containing fumed silica. The fast band effect causes an annular region of the substrate, the center of which is located approximately 15 millimeters from the substrate edge, to be significantly over-polished. This annular region may be about 20 millimeters wide. Where the polishing pad 140 is constructed to counter the fast band effect, the first region 150 may have a radius $W_1$ of about 3.2 inches, the second region 152 may have a width $W_2$ of about 4.8 inches, the third region 154 may have a width $W_3$ of about 1.2 inches, and the fourth region 156 may have a width $W_4$ of about 0.8 inches. Such widths are employed for a polishing pad about 20 inches in diameter. For such a pad, the substrate may be moved across the polishing pad surface at a sweep range of about 0.8 inches, so that the substrate oscillates to about 0.2 inches from the edge of the pad at the outermost point of the oscillation and about 1.0 inches from the center of the pad at the innermost point of the oscillation.

It appears that the polishing rate is comparable to the percentage of polishing pad surface area that contacts the substrate during polishing. By providing the polishing pad with a region in which more cross-sectional surface area is occupied by the grooves, the polishing rate is reduced in that region. Specifically, the closely-spaced grooves in region 154 decrease the polishing rate in the otherwise over-polished portions of the substrate. Consequently, the polishing pad compensates for the fast band effect and improves polishing uniformity.

Figure 8:
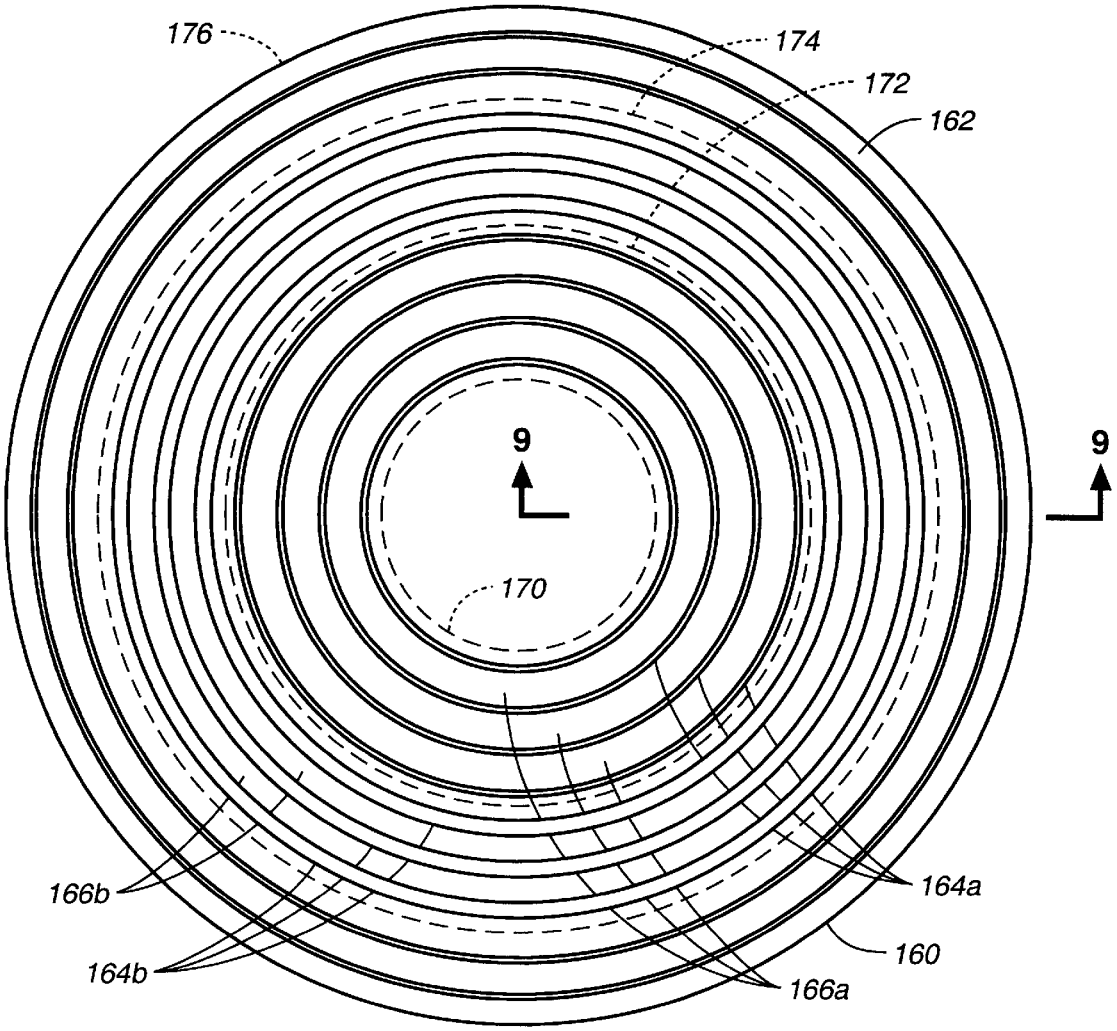
FIG. 8 is a schematic top view of a polishing pad having regions with different groove widths.
Figure 9:
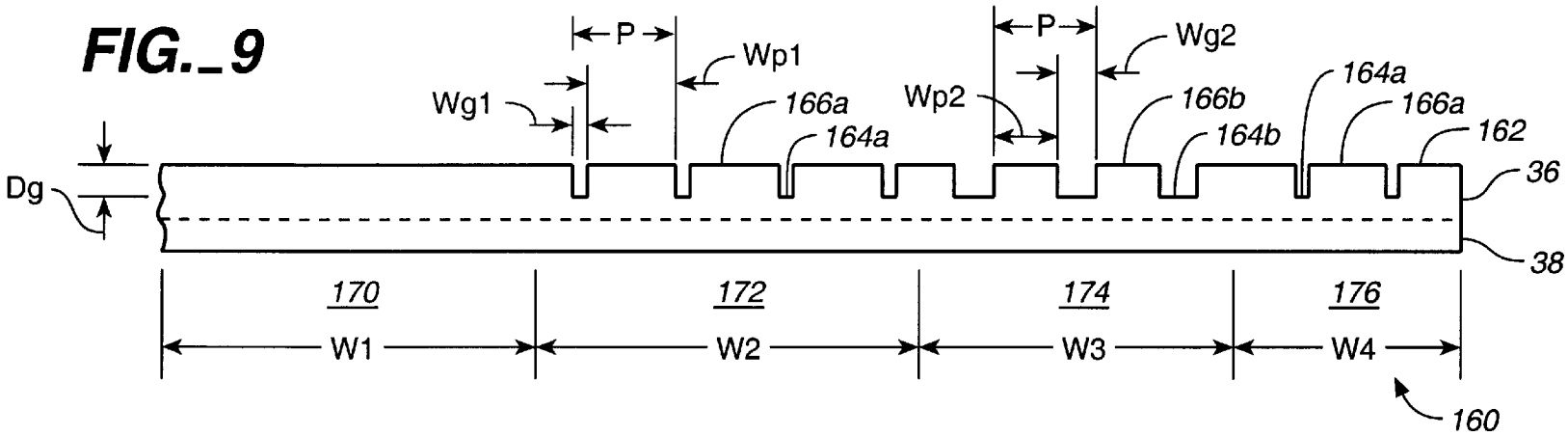
FIG. 9 is a cross-sectional view of the polishing pad of FIG. 8 along line 9—9.

In another embodiment, referring to FIGS. 8 and 9, a plurality of concentric circular grooves 164*a*, 164*b* are disposed in a polishing surface 162 of a polishing pad 160. These grooves 164*a*, 164*b* may be uniformly spaced with a pitch P. However, the grooves do not have a uniform width.

In one implementation, the polishing surface 162 is divided into four concentric regions, including an innermost region 170, an outermost region 176, and two intermediate regions 172,174. Region 170 may be constructed without grooves, and the grooves 164*b* in region 174 may be wider than the grooves 164*a* in regions 172,176. The narrow grooves 164*a* may have a width $W_{g1}$ whereas the wide grooves 164*b* may have a width $W_{g2}$. Between each narrow groove 164*a* is a wide annular partition 166*a* having a width $W_{p1}$, whereas between each wide groove 164*b* is a narrow annular partition 166*b* having a width $W_{p2}$.

The wide grooves may be approximately two to twenty times, e.g., six times, wider than the narrow grooves. The narrow grooves 164*a* may have a width $W_{g1}$ between about 0.015 and 0.04 inches, such as 0.02 inches, whereas the wide grooves 164*b* may have a width $W_{g2}$ between about 0.04 and 0.3 inches, such as 0.125 inches. The wide partitions 166*a* may have a width $W_{p1}$ of between about 0.10 and 0.385 inches, such as 0.18 inches, whereas the narrow partitions 166*b* may have a width $W_{p2}$ between about 0.05 and 0.10 inches, such as 0.075 inches. The grooves may be evenly spaced with a pitch P between about 0.09 and 0.40 inches, such as 0.2 inches. In the narrow groove regions 172,176 the partitions cover about 75% of the available cross-sectional surface area whereas in the wide-grooved region 174 the partitions cover about 50% of the available cross-sectional surface area.

It should be noted that a variety of groove widths and/or spacings may be used to achieve the desired contact surface area. A key factor is that there be less surface area to contact the portions of the substrate which would otherwise be over-polished. A polishing pad 160 having non-uniform groove spacings and widths may also be useful in processes in which non-uniform polishing of a substrate is desired.

Figure 11:
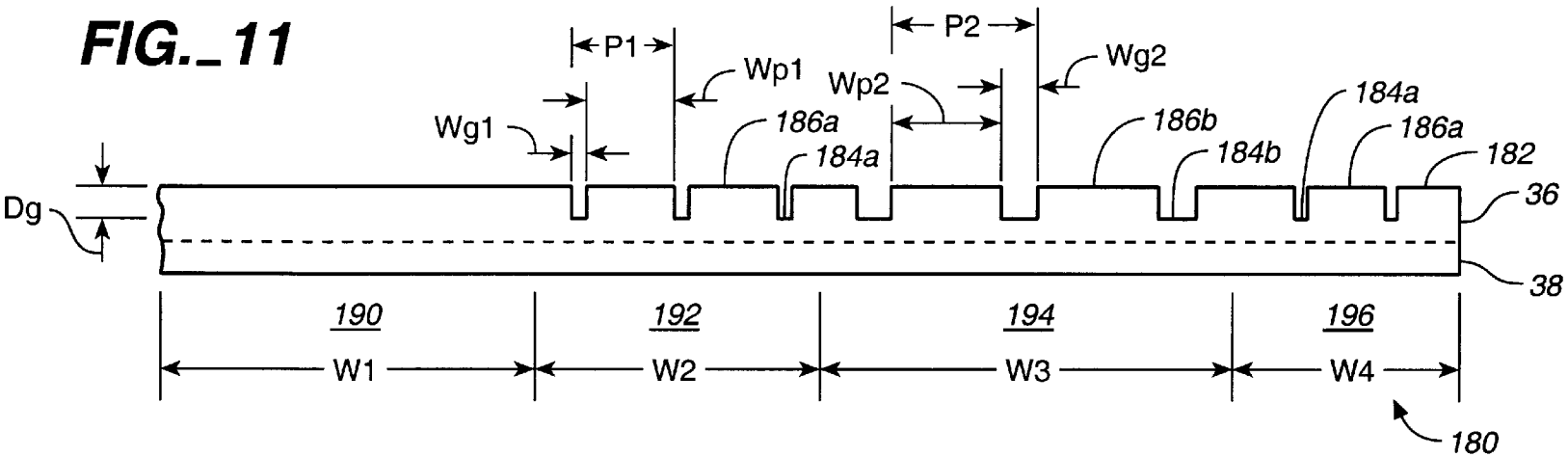
FIG. 11 is a cross-sectional view of the polishing pad of FIG. 10 along line 11—11.
Figure 10:
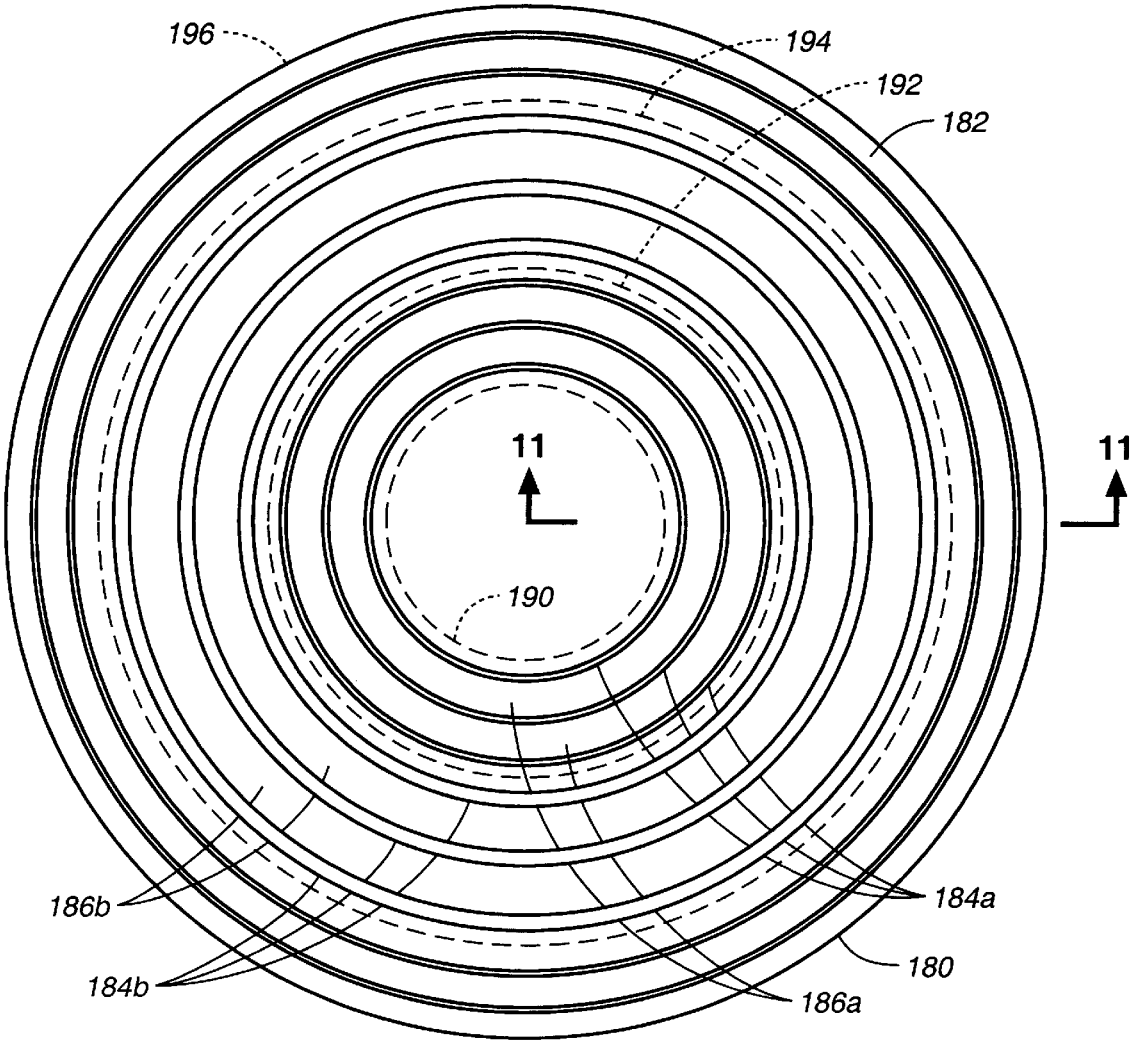
FIG. 10 is a schematic top view of a polishing pad having regions with different groove widths and different groove spacing.

In another embodiment, referring to FIGS. 10 and 11, a plurality of concentric circular grooves 184*a*, 184*b* are disposed in a polishing surface 184 of a polishing pad 180. The grooves 184*a*, 184*b* have both a non-uniform pitch and a non-uniform width.

In one implementation, the polishing surface 182 is divided into four substantially circular concentric regions including an innermost region 190, an outermost region 196, and two intermediate regions 192,194. The region 190 may be constructed without grooves, and the grooves 184*b* in one of the intermediate regions 194 may be wider but spaced farther apart than the grooves 184*a* in one of the intermediate regions 192 and the outermost region 196. The narrow grooves 184*a* may have a width $W_{g1}$ of about 0.02 inches, whereas the wide grooves 184*b* may have a width $W_{g2}$ of about 0.125 inches.

The narrow grooves 184*a* may be disposed with a pitch $P_1$ of about 0.12 inches, whereas wide grooves 184*b* in one of the intermediate regions 194 may be disposed with a pitch $P_2$ of about 0.2 inches. Between each narrow groove 184*a* is an annular partition 186*a* having a width $W_{p1}$ of about 0.1 inches, whereas between each wide groove 184*b* is a annular partition 186*b* having a width $W_{p2}$ of about 0.075 inches.

Figure 12:
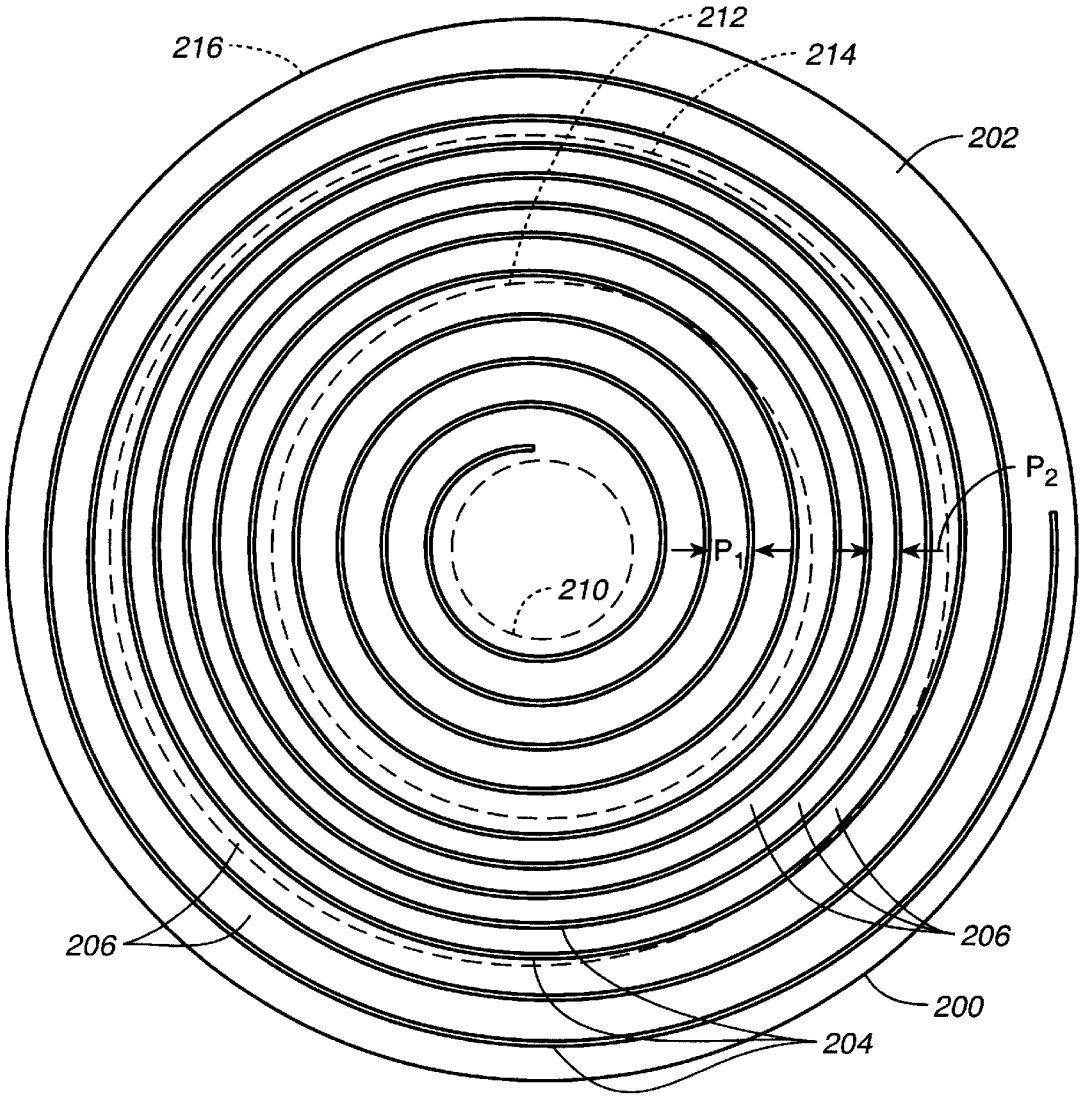
FIG. 12 is a schematic top view of a polishing pad having a spiral groove and regions of different groove pitch.

Referring to FIG. 12, in another embodiment, a spiral groove 204 is disposed in a polishing surface 202 of a polishing pad 200. A spiral partition 206 separates the rings of the spiral. The groove 204 may have a non-uniform pitch. The width of the groove 204 may be uniform or non-uniform.

The polishing surface 202 may be divided into four concentric regions including an innermost region 210, an outermost region 216, and two intermediate regions 212, 214. In one of the intermediate regions 214 the spiral groove has a narrower pitch than in the other intermediate region 212 and the outermost region 216. Specifically, the spiral groove 204 may have a pitch $P_1$ of about 0.20 inches in one of the intermediate regions 212 and the outermost region 216, and a pitch $P_2$ of about 0.12 inches in the other intermediate region 214. The spiral groove 204 does not extend into region 210.

Figure 13:
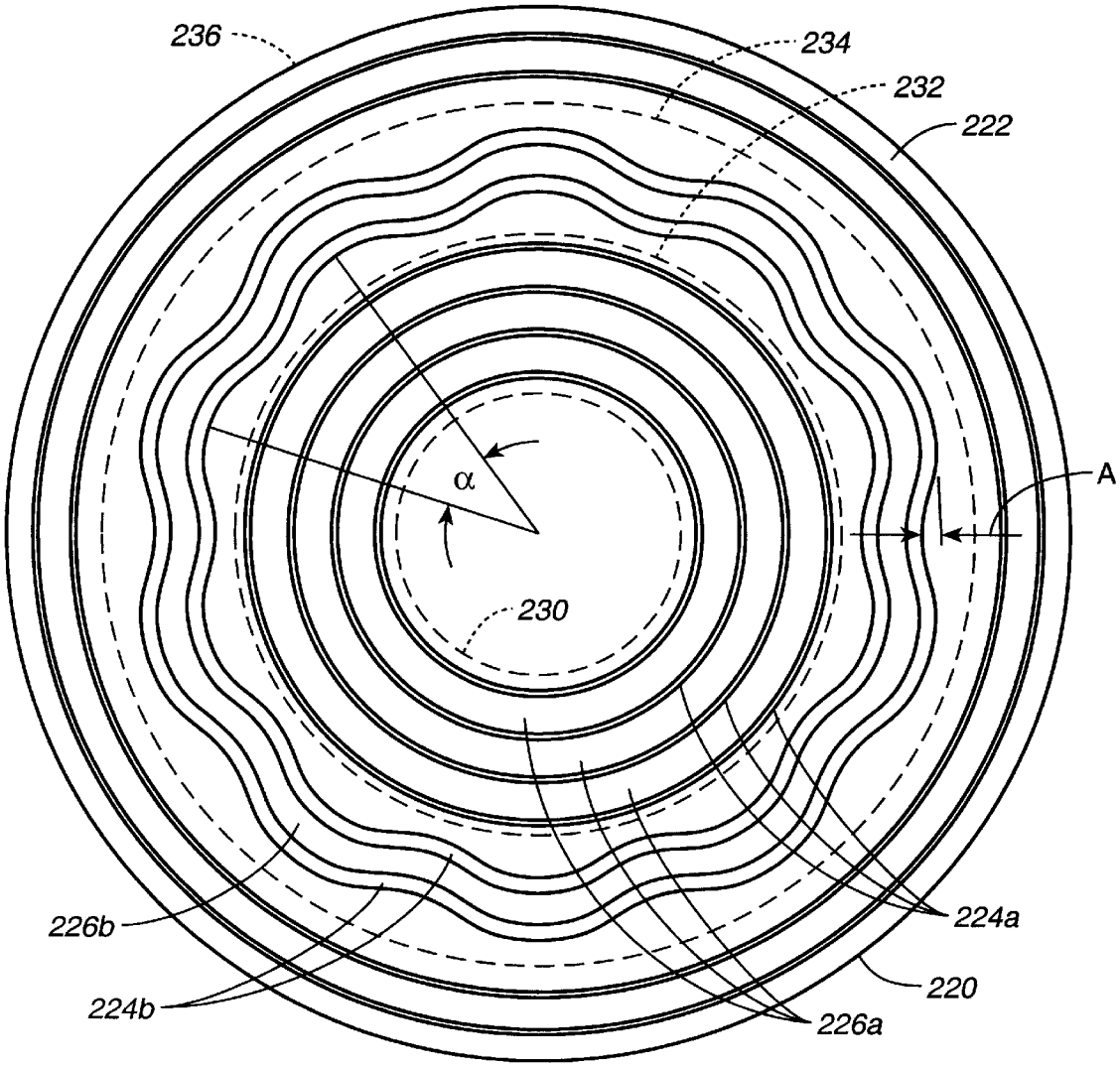
FIG. 13 is a schematic top view of a polishing pad having concentric circular grooves and serpentine grooves.

Referring to FIG. 13, in another embodiment, a plurality of concentric circular grooves 224*a* and a plurality of serpentine grooves 224*b* are disposed in a polishing surface 224 of a polishing pad 220. The serpentine grooves 224*b* may be wider than circular grooves 224*a*. Between each circular groove 224*a* is an annular partition 226*a*, whereas between each serpentine groove 224*b* is a serpentine partition 226*b*. Although not illustrated, some of the serpentine grooves 224*b* may intersect some of the circular grooves 224*a*.

The polishing surface 222 may be divided into four concentric regions, including an innermost region 230, an outermost region 236, and two intermediate regions 232, 234. The innermost region 230 may be constructed without grooves, whereas the serpentine grooves 224*b* may be located in one of the intermediate regions 234. The circular grooves 224*a* may be located in the other intermediate region 232 and the outermost region 236.

The circular grooves 224*a* may be constructed to have a width of about 0.02 inches and a pitch of about 0.12 inches. Each of the serpentine grooves 224*b* may undulate between an innermost and an outermost radius with an amplitude (A) of about 0.1 to 0.5 inches, such as 0.2 or 0.4 inches. Each undulation of the serpentine groove 224*b* may extend through an angle ($\alpha$) between about 5 and 180 degrees, such as 15 degrees. Thus, each serpentine groove 224*b* may have between about 2 and 72 (e.g., 24) undulations. The serpentine grooves 224*b* may have a width of about 0.125 inches and a pitch of about 0.20 inches. The second pitch of the serpentine grooves 224 may be between about one and two times the amplitude, or between about 1.5 and 2 times the second width.

In an exemplary polishing pad 220, one of the intermediate regions 232 may extend from a radius of about 3.2 inches to a radius of about 8.0 inches, the other intermediate region 234 may extend from a radius of about 8.0 inches to a radius of about 9.2 inches. The outermost region 236 may extend from a radius of about 9.2 inches to a radius of about 9.92 inches.

Figure 14:
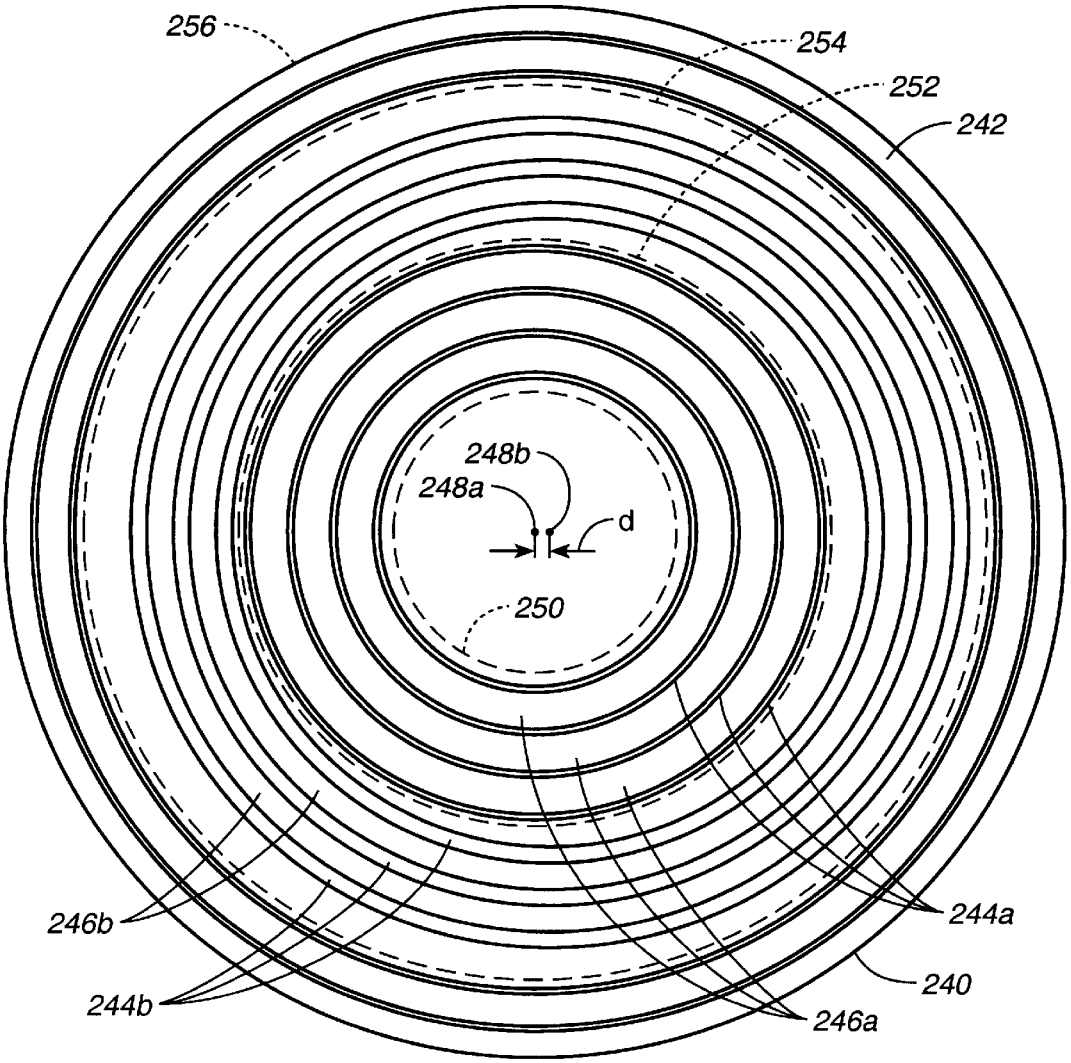
FIG. 14 is a schematic top view of a polishing pad having circular grooves with different radial centers.

Referring to FIG. 14, in still another embodiment, the circular grooves 244*a*, 244*b* are disposed in a polishing surface 242 of a polishing pad 240. The grooves 244*a*, 244*b* have non-uniform widths. In addition, the grooves 244*a* are concentric about a point 248*a*, whereas the grooves 224*b* are concentric about a different point 248*b*. The grooves 244*a* are separated by annular partitions 246*a*, whereas the grooves 244*b* are separated by annular partitions 246*b*. The center points 248*a*, 248*b* may be separated by a distance (d) approximately equal to the pitch between grooves 244*b*. Although not illustrated, some of the circular grooves 244*a* may intersect some of the circular grooves 244*b*.

The polishing surface 242 is divided into four concentric regions including an innermost region 250, an outermost region 256, and two intermediate regions 252,254. The grooves in one of the intermediate regions 252 and the outermost region 256 are concentric about one point 248*a*, whereas the grooves in the other intermediate region 254 are concentric about another point 248*b*. The grooves 244*a*, 244*b* in the intermediate regions 252,254 may have widths of 0.02 to 0.125 inches, respectively, and a pitch of about 0.20 to 0.24, respectively.

Figure 15:
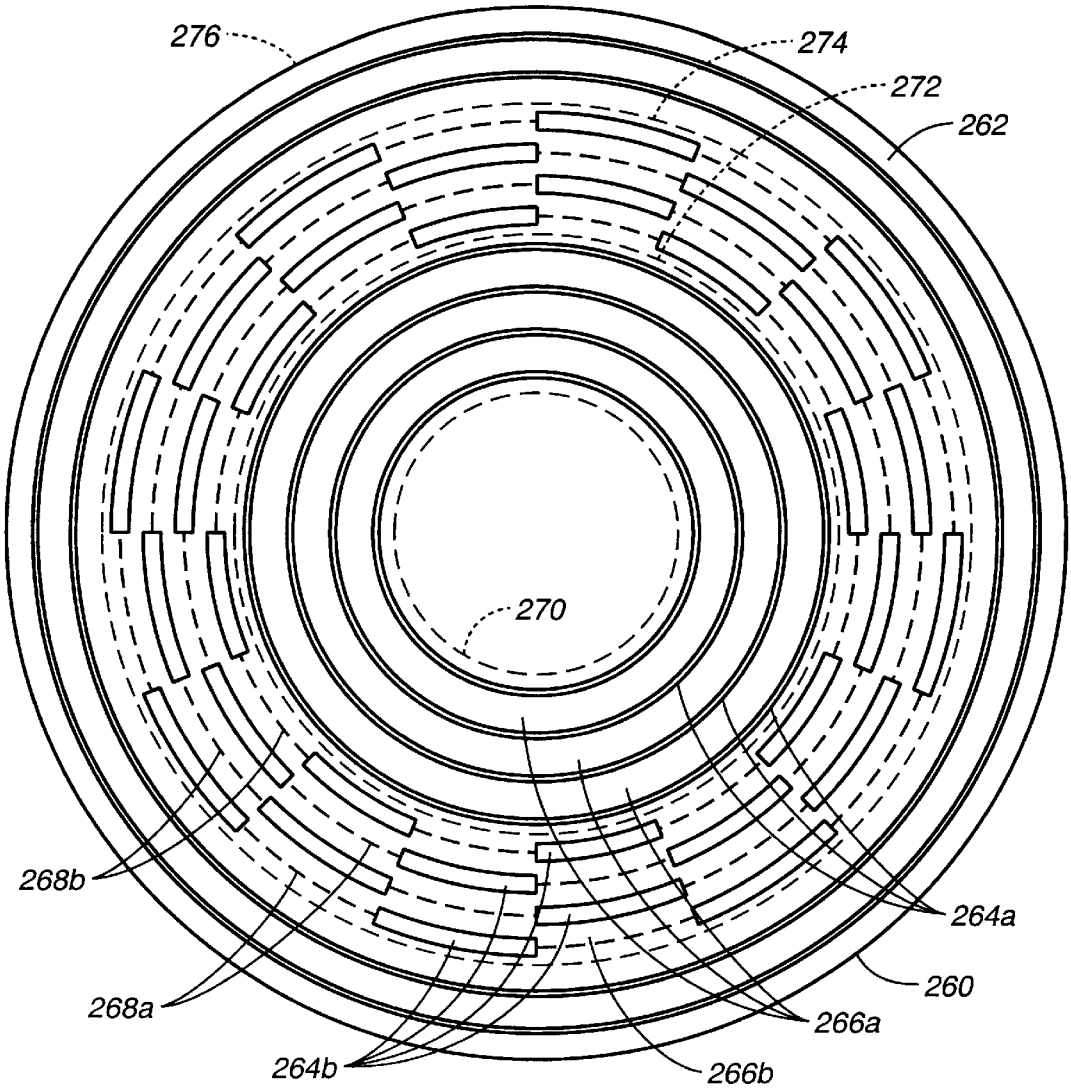
FIG. 15 is a schematic top view of a polishing pad having concentric circular grooves and groove arc segments.

Referring to FIG. 15, in yet another embodiment, a plurality of concentric circular grooves 264*a* and a plurality of segmented groove arcs 264*b* are formed in a polishing surface 262 of a polishing pad 260. The segmented groove arcs 264*b* are disposed along adjacent concentric circular paths 268*a*, 268*b*. The arcs 264*b* may be offset so that the arcs 264*b* on the paths 268*a* are not adjacent to the arcs 264*b* on the paths 268*b*. An annular partition 266*a* separates each circular groove 264*a*, whereas a single partition 266*b* encompasses the groove arcs 264*b*. As used herein, an "arc" is defined as a segmented groove having a curvature about a point in the innermost concentric region of the polishing pad.

The polishing surface 262 may be divided into four concentric regions including an innermost region 270, an outermost region 276, and two intermediate regions 272, 274. The innermost region 270 may be constructed without grooves, whereas groove arcs 264*b* may be located in one of the intermediate regions 274. The circular grooves 264*a* may be located in the other intermediate region 272 and the outermost region 276. The circular grooves 264*a* may have a width of about 0.02 inches and a pitch of about 0.20 inches. The groove arcs 264*b* may have a width of about 0.125 inches in the radial direction. The circular paths 268*a*, 268*b* may be spaced apart by about 0.2 inches. In this embodiment, the pitch may be considered as the between adjacent circular paths.

Figure 16:
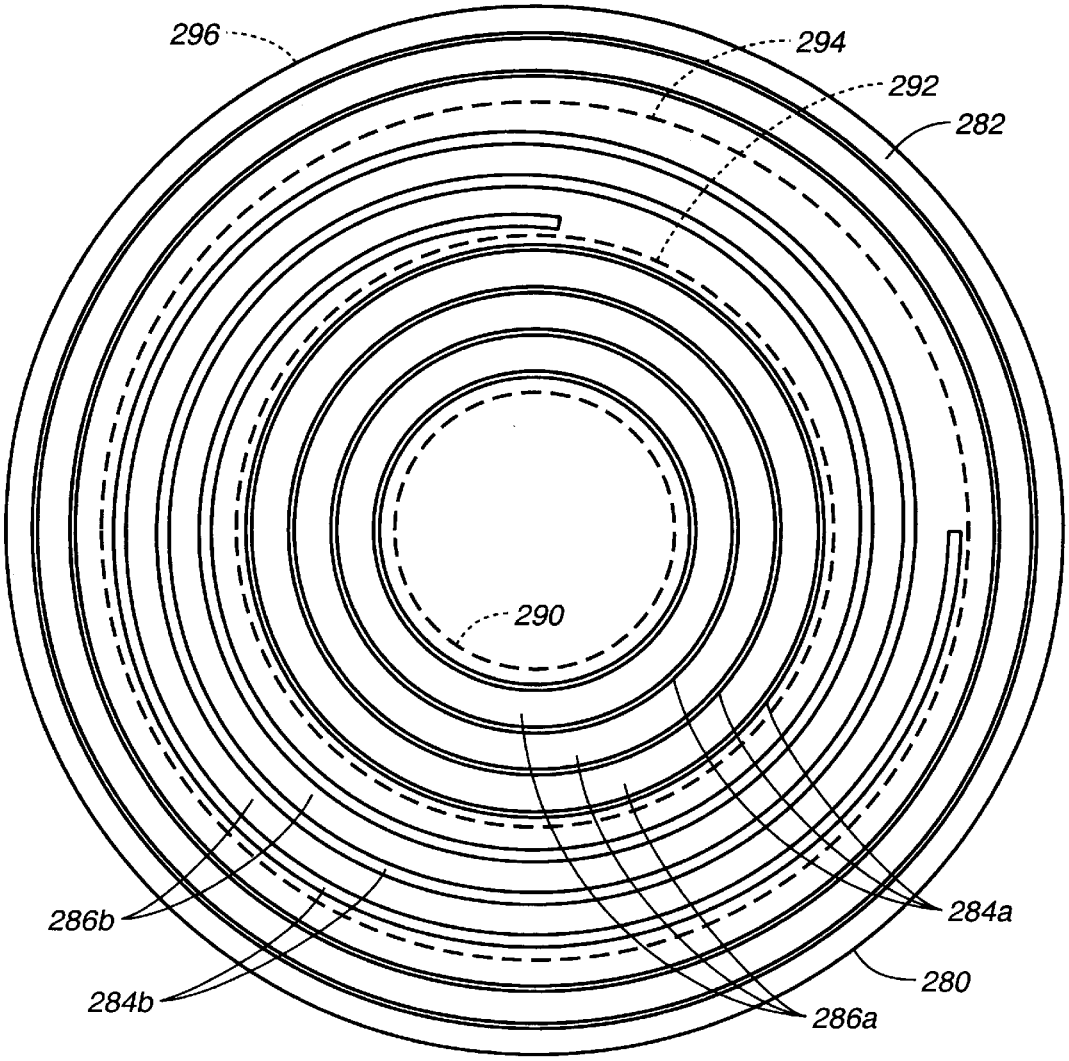
FIG. 16 is a schematic top view of a polishing pad having both concentric circular grooves and a spiral groove.

Referring to FIG. 16, in still another embodiment, a plurality of concentric circular grooves 284*a* and a spiral groove 284*b* are formed in a polishing surface 282 of a polishing pad 280. An annular partition 286*a* separates each circular groove 284*a*, whereas a spiral groove 284*b* defines a spiral partition 286*b*.

The polishing surface 282 may be divided into four concentric regions, including an innermost region 290, an outermost region 296, and two intermediate regions 292, 294. The innermost region 290 may be constructed without grooves, whereas the spiral groove 284*b* may be located in one of the intermediate regions 294. The circular grooves 284*a* may be located in the other intermediate region 292 and the outermost region 296. The circular grooves 284*a* may be constructed similarly to the circular grooves 264*a* and have a width of about 0.02 inches and a pitch of about 0.12 inches. The spiral groove 284*b* may have a width of about 0.125 inches and a pitch of about 0.2 inches.

In an exemplary polishing pad 280, the innermost region 290 may extend from a radius of about 3.2 inches to a radius of about 7.88 inches. One of the intermediate regions 292 may extend from a radius of about 8.0 inches to a radius of about 9.2 inches, and the other intermediate region 294 may extend from a radius of about 9.32 inches to a radius of about 9.92 inches.

In addition, in all of the embodiments, there may be gradients of groove width and/or partition width between adjacent regions. These gradients provide polishing at rates intermediate to the rates in the adjacent regions. Since the substrate is oscillated across the polishing pad surface, the intermediate polishing rates will provide more uniform polishing between adjacent areas of the substrate.

Figure 17:
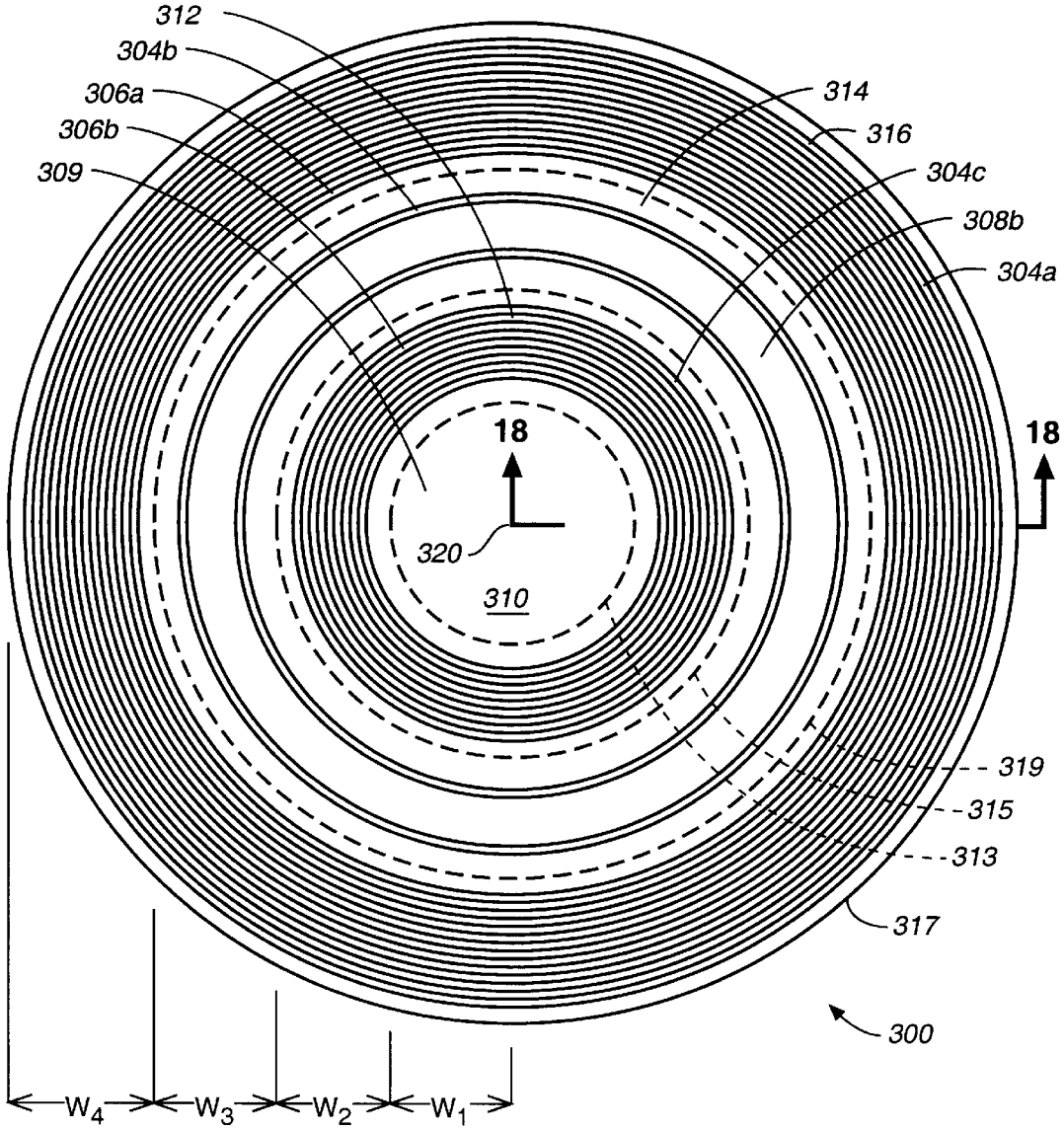
FIG. 17 is a schematic top view of a polishing pad having regions of different groove spacing.
Figure 18:
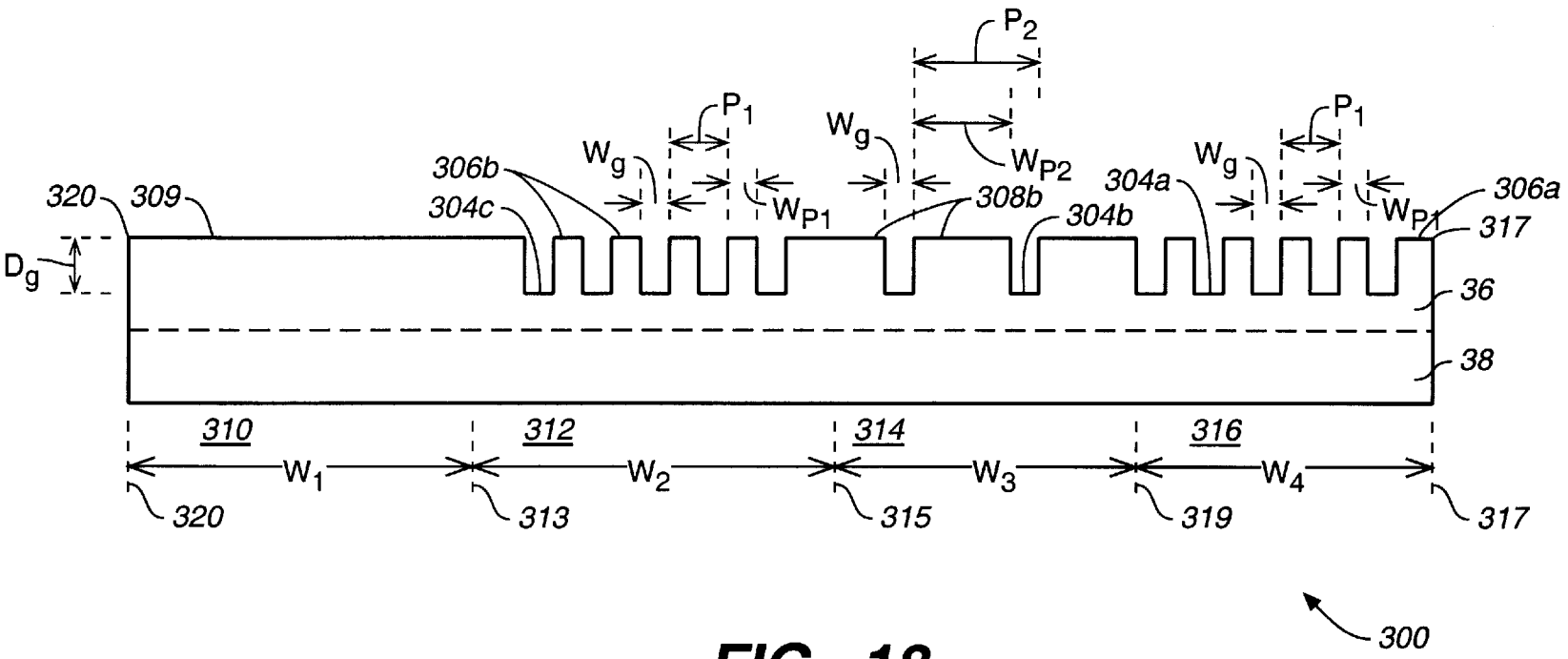
FIG. 18 is a cross-sectional view of the polishing pad of FIG. 17 along line 18—18.

As shown in FIGS. 17 and 18, the polishing pad 300 includes four regions 310, 312, 314, and 316. An outermost region 316 has a radial width $W_4$, and is bounded by the pad edge 317 and an outer imaginary line 319 between the outermost region 316 and an outer intermediate region 314. The outer intermediate region 314 has a radial width $W_3$, and is bounded by the outer imaginary line 319 and an intermediate imaginary line 315 between the outer intermediate region 314 and the inner intermediate region 312. The inner intermediate region 312 is bounded by an inner imaginary line 313 and the intermediate imaginary line 315. The inner intermediate region 312 has a radial with of $W_2$. The innermost region 310 is bounded by the inner imaginary line 313 and has a radius $W_1$. The values for $W_1$, $W_2$, $W_3$ and $W_4$ for the embodiment shown in FIGS. 17 and 18 may be similar to the values for of $W_1$, $W_2$, $W_3$ and $W_4$ for the embodiment shown in FIGS. 5 and 6, e.g., about 3 inches, 5 inches, 1 inch and 1 inch, respectively. In general, the groove depth, width, pitch and partition width within a region may be uniform within each region.

The outermost concentric region 316 includes a plurality of substantially circular concentric grooves 304*a* having a depth $D_g$, a width $W_g$, and a pitch $P_1$. Between the grooves 304*a* are a plurality of partitions 306*a* having a width $W_{P1}$. Similarly, the inner intermediate region 312 includes a plurality of substantially circular concentric grooves 304*c* having a depth $D_g$, a width $W_g$, and a pitch $P_1$. The inner intermediate region 312 also includes a plurality of partitions 306*b* having a width $W_{P1}$.

The outer intermediate region 314 also includes a plurality of substantially circular concentric grooves 304*b* having a groove width of $W_g$, a depth $D_g$ and a pitch $P_2$. The outer intermediate region 314 includes a plurality of partitions 308*b* having a width $W_{P2}$. The groove pitch $P_2$ is greater than the groove pitch $P_1$, and the partition width $W_{P2}$ is greater than the partition width $W_{P1}$.

As discussed, the grooves depth $D_g$ may be about 0.02 for a 0.05 inch thick upper layer 36 or about 0.03 for a 0.08 inch thick upper layer 36. The groove width $W_g$ may be in the range of about 0.015 to 0.04 inches, such as about 0.02 inches. The width $W_{P2}$ of the partitions 308 in the outer intermediate region 314 may be in the range of about 0.12 to 0.24 inches, such as about 0.18 inches. Correspondingly, the pitch $P_2$ in the outer intermediate region 314 may be in the range of about 0.09 to 0.24 inches, such as about 0.2 inches. Hence, the available surface area for polishing in the outer intermediate region 314 may be about 75–90%, e.g., 83%, of the total available cross-sectional surface area.

In contrast, the partition width $W_{P1}$ in the outermost and inner intermediate regions 316,312 may be in the range of about 0.04 to 0.12 inches, such as about 0.08 inches. Correspondingly, the pitch $P_1$ in the outermost and inner intermediate regions 316,312 may be in the range of about 0.045 to 0.2 inches, such as about 0.1 inches. As a result, the available surface area for polishing in the outermost and inner intermediate regions 316, 312 may be about 50–75%, e.g., 69%, of the total available cross-sectional surface area.

The grooves 304*a*, 304*b*, 304*c* have a uniform width $W_g$ and uniform depth $D_g$ and are concentric to a center point 320 of the polishing pad 300. In addition, the grooves 304*a*, 304*b*, 304*c* are uniform in pitch within their respective regions with $P_2$ being up to about two or three times larger then $P_1$. Correspondingly, the width of the partitions $W_{P1}$, $W_{P2}$ are uniform within their respective regions with $W_{P2}$ being up to about two or three times larger than $W_{P1}$.

As a result of the design and configuration of the grooves 304*a*, 304*b*, 304*c* in the polishing pad 300, the substrate would be polished at a relatively slower rate in regions 312 and 316 than in region 314. The polishing rate attributable to the outer intermediate region 314 is faster because that region contains fewer grooves (but still some grooves to provide polishing slurry to the pad/substrate interface) and hence a higher percentage of polishing surface area contacts the substrate than the outermost region 316 and the inner intermediate region 312.

In operation, the substrate may be polished by being moved radially across the polishing pad 300 such that the substrate's outermost concentric area spends more time being polished by the polishing pad's outermost region 316 and the inner intermediate region 312, while the substrate's inner concentric area spends more time being polished by the polishing pad's outer intermediate region 314.

Thus, the polishing pad 300 advantageously eliminates or substantially reduces any band or edge effect in the outermost concentric area of the substrate. The polishing pad 300 can also eliminate or substantially reduce the drawbacks associated with an uneven or non-uniform film deposition whereby the film thickness (before polishing) within the outermost concentric area of the substrate is thinner than the deposited film thickness within the inner concentric area of the substrate.

Figure 19:
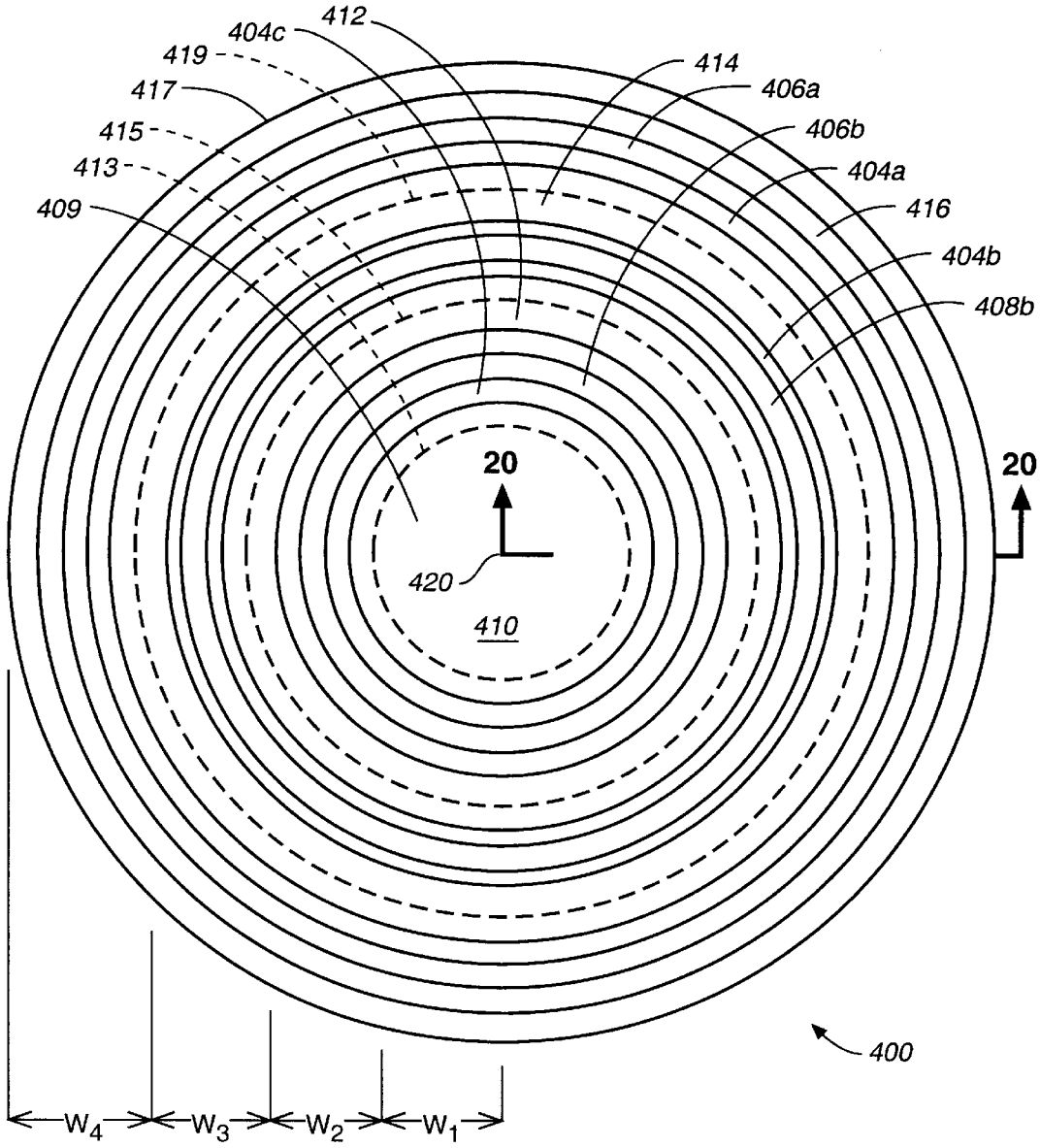
FIG. 19 is a schematic top view of a polishing pad having regions of different groove widths.
Figure 20:
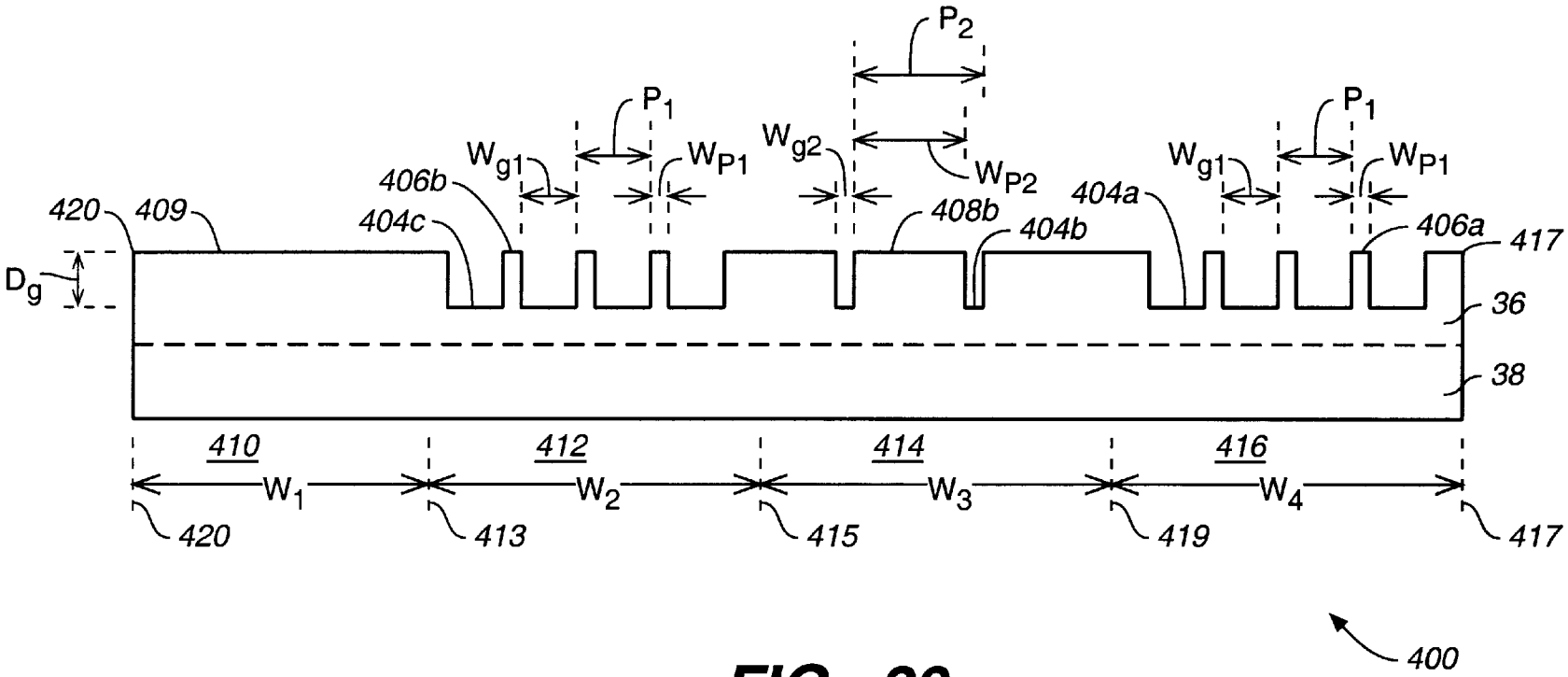
FIG. 20 is a cross-sectional view of the polishing pad of FIG. 19 along line 20—20.

As shown in FIGS. 19 and 20, the polishing pad 400 includes four regions 410, 412, 414, and 416 concentric about pad center 420. The outermost region 416 has a radial width $W_4$ and is bounded by a pad edge 417 and an outer imaginary line 419. The innermost region 410 has a radial width $W_1$ and is bounded by pad center 420 and an inner imaginary line 413. An outer intermediate region 414 has a radial width $W_3$, and is bounded by the outer imaginary line 419 and an intermediate imaginary line 415 between the outer intermediate region 414 and the inner intermediate region 412. The inner intermediate region 412 has a radial width of $W_2$, and is bounded by the inner imaginary line 413 and the intermediate imaginary line 415. The values for $W_1$, $W_2$, $W_3$ and $W_4$ for the embodiment shown in FIGS. 19 and 20 may be similar to the values for of $W_1$, $W_2$, $W_3$ and $W_4$ for the embodiment shown in FIGS. 17 and 18

The outermost concentric region 416 includes a plurality of substantially circular concentric grooves 404*a* having a depth $D_g$, a width $W_{g1}$, and a pitch $P_g$. Between the grooves 404*a* are a plurality of partitions 406*a* having a width $W_{P1}$. Similarly, the inner intermediate region 412 includes a plurality of substantially circular concentric grooves 404*c* having a depth $D_g$, a width $W_{g1}$, and a pitch $P_1$. The inner intermediate region 412 also includes a plurality of partitions 406*b* having a width $W_{P1}$.

The outer intermediate region 414 includes a plurality of substantially circular concentric grooves 404*b* having a groove width $W_{g2}$, a depth $D_g$ and a pitch $P_g$. The outer intermediate region 414 also includes a plurality of partitions 408*b* having a width $W_{P2}$. The groove width $W_{g2}$ is smaller than the groove width $W_{g1}$. The partition width $W_{P2}$ in the outer intermediate region 414 is greater than the partition width $W_{P1}$ in the outermost and inner intermediate regions 416,412. The pitch $P_g$ may be in the range of about 0.09 to 0.4 inches, such as about 0.2 inches.

The grooves depth $D_g$ may be between about 0.02 and 0.03 inches. The groove width $W_{g2}$ may be in the range of about 0.015 to 0.04 inches, such as about 0.02 inch. The groove width $W_{g1}$ may be in the range of about 0.04 to 0.3 inches, such as 0.125 inches. The ratio $W_{g1}$:$W_{g2}$ may be in the range of about 2:1 to 20:1, such as about 6:1.

The width $W_{P2}$ of the partitions 408 in the outer intermediate region 414 may be in the range of about 0.1 to 0.385 inches, such as about 0.18 inches. Correspondingly, the pitch $P_2$ in the outer intermediate region 414 may be in the range of about 0.09 to 0.4 inches, such as about 0.2 inches. Hence, the available surface area for polishing in the outer intermediate region 414 may be about 75% [range?] of the total surface area.

The partition width $W_{P1}$ in the outermost and inner intermediate regions 416,412 may be in the range of about 0.05 to 0.10 inches, such as about 0.075 inches. As a result, the available surface area for polishing in the outermost and inner intermediate regions 416,412 may be about 50% [range?] of the total surface area of the region 416,412.

As shown in FIGS. 19 and 20, the grooves have a uniform width $W_{g1}$ in the outermost and inner intermediate regions 416,412 and a uniform width $W_{g2}$ in the outer intermediate region 414. Moreover, the grooves 404*a*, 404*b*, 404*c* may have a uniform depth $D_g$ in the inner, outer intermediate and outermost regions 412,414,416. In addition, the grooves may be uniform in pitch within the respective regions. Correspondingly, as shown in FIGS. 19 and 20, the width of the partitions within each of the respective regions is uniform.

As a result of the design and configuration of the grooves 404*a*, 404*b*, 404*c* in the polishing pad 400, the outermost concentric area of the substrate can be polished at a relatively slower rate than the substrate's inner concentric region. The polishing rate attributable to the outer intermediate region 414 is faster because that region contains narrower grooves and thus a higher percentage of active surface area, but still enough grooves to provide polishing slurry to the pad/substrate interface.

In contrast, the polishing rate attributable to the outermost region 416 and the inner intermediate region 412 is relatively slower because those regions have less surface area available for polishing. Polishing may be conducted such that the substrate's outermost concentric area spends more time being polished by the outermost and inner intermediate regions 416,412 which impart a relatively slower polishing rate. Correspondingly, the substrate's inner concentric area can spend more time being polished by the polishing pad's outer intermediate region 414 which imparts a relatively higher polishing rate.

Thus, the polishing pad 400 advantageously eliminates or substantially reduces any band or edge effect in the outermost concentric area of the substrate. The polishing pad 400 also eliminates or substantially reduces the drawbacks associated with an uneven or non-uniform film deposition where the film thickness (before polishing) within the outermost concentric area of the substrate is thinner than the deposited film thickness within the inner concentric area of the substrate.

Figure 21:
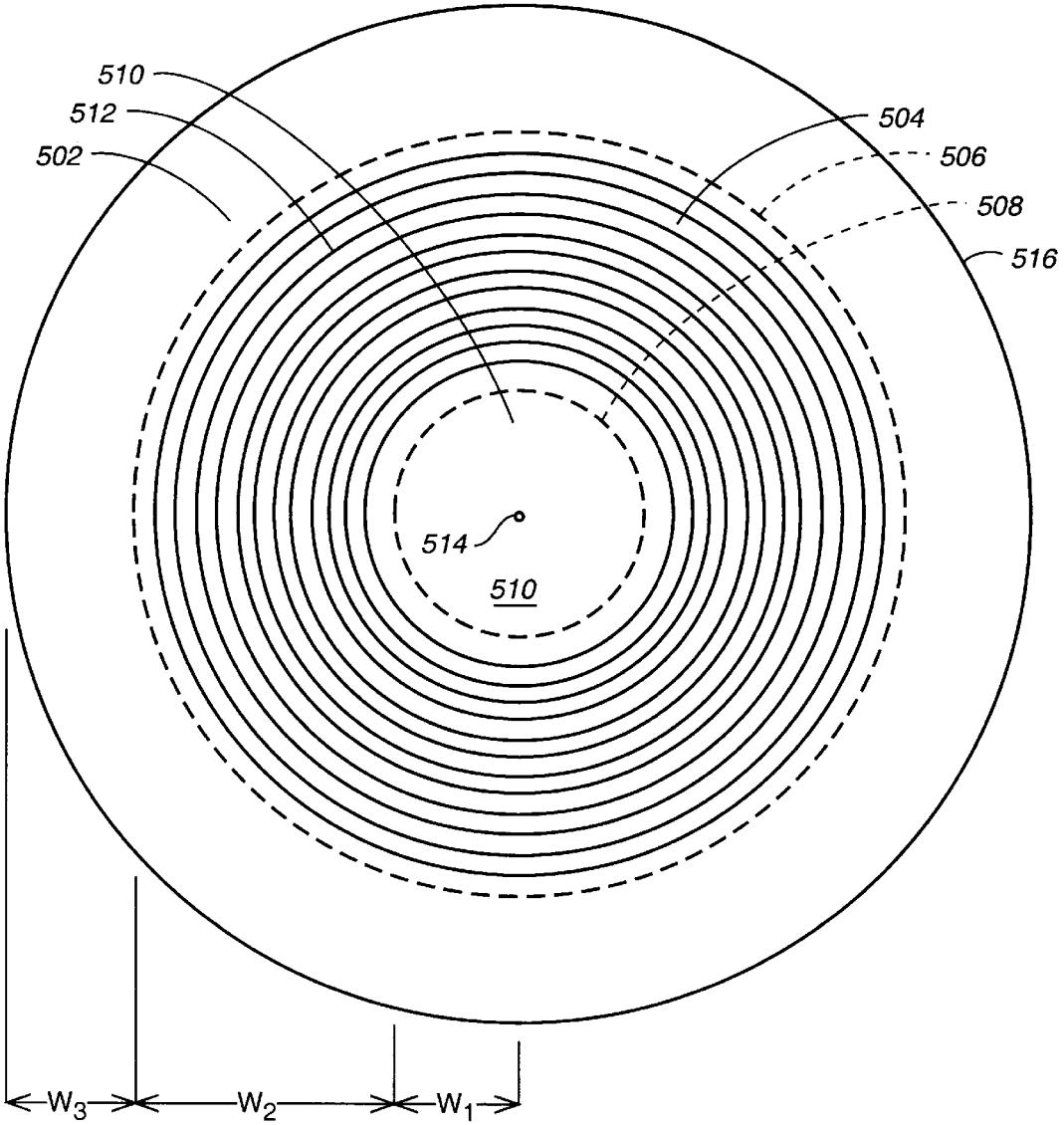
FIG. 21 is a schematic top view of a polishing pad free of grooves in the inner and outermost concentric regions.

As shown in FIG. 21, polishing pad 500 may include an inner region 510 bounded by an inner imaginary line 508. The pad 500 also includes an outer region 502 bounded by an outer imaginary line 506 and an edge 516 of the pad. Still further, the pad 500 includes an intermediate region 504 bounded by the inner imaginary line 508 and the outer imaginary line 506. The inner and outer regions 510,502 are free of grooves whereas the intermediate region 504 includes a plurality of substantially circular grooves 512 concentric about a center 514 of the polishing pad 500. The radial widths of the regions are selected so that the edges of a substrate positioned on the polishing pad overlie the grooveless inner and outer regions 510, 502. For example, the inner region 510 may have a radius $W_1$ of about 3 inches, the intermediate region 504 may have a radial width $W_2$ of about 5 to 6 inches, and the outer region 502 with a radial width $W_3$ of about 1 to 2 inches.

The polishing pad 500 can advantageously provide a lower polishing rate at the outermost concentric region of the substrate. Specifically, the polishing process is conducted such that the substrate's outermost concentric region spends proportionally more polishing time in the groove-free inner and outer regions 510, 502 as the substrate is radially oscillated across the pad 500. As such, the polishing pad 500 overcomes or substantially reduces the problems associated with edge-fast polishing, a polishing ring, or a thinner film in the outer edge area of the substrate. This polishing pad is particularly useful for polishing substrates having an exposed metal layer, which tend to be overpolished at the substrate edge.

Figure 22:
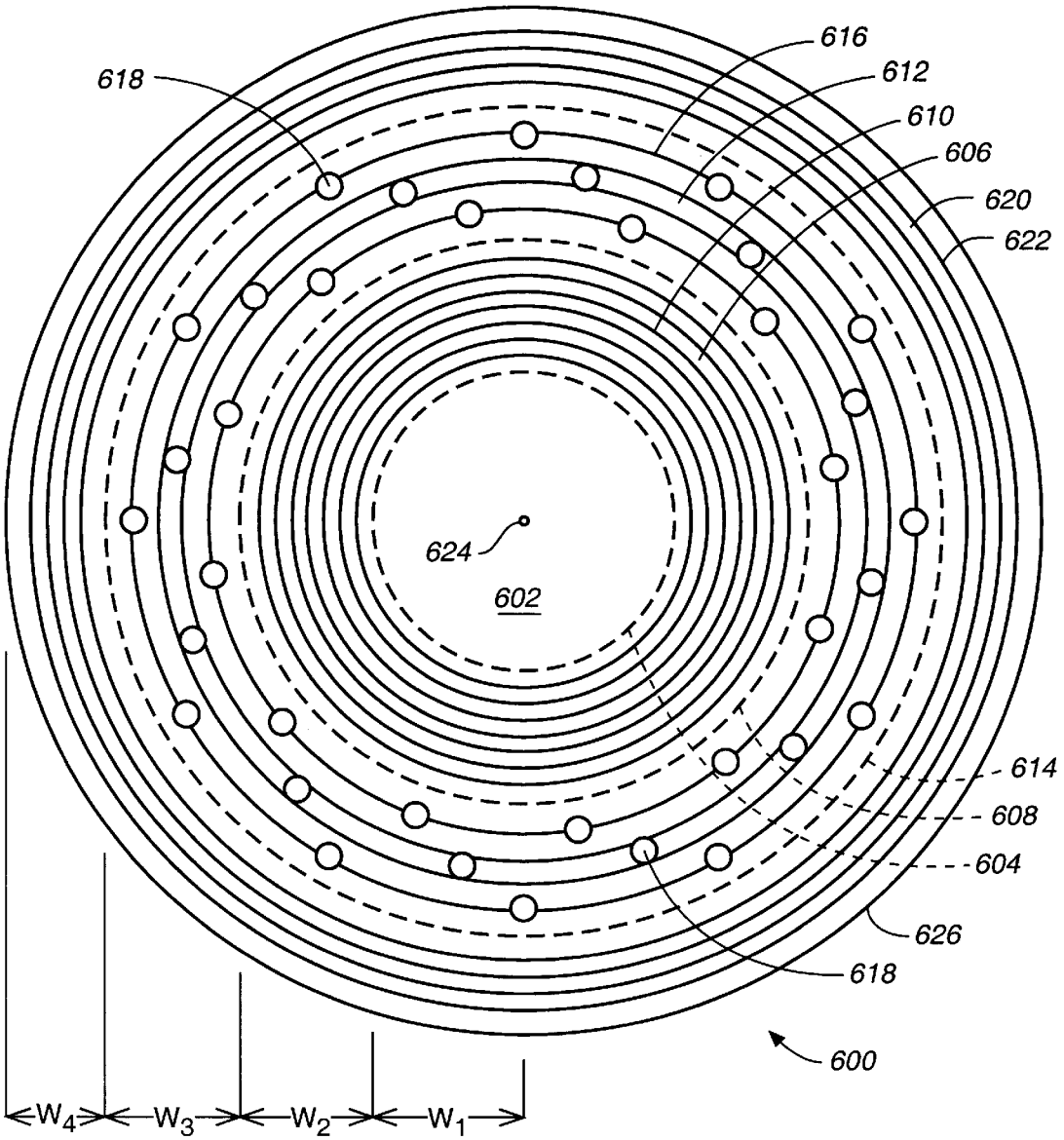
FIG. 22 is a schematic top view of a polishing pad having grooves in combination with perforations in an intermediate concentric region.

As shown in FIG. 22, polishing pad 600 includes an inner region 602 bounded by an inner imaginary line 604. The inner region 602 has a radius $W_1$ of, for example, about 3 inches. The pad 600 further includes an outermost region 620 bounded by an outer imaginary line 614 and an outer edge 626 of the pad. The outermost region 620 had a radial width $W_4$ of, for example, about 1 inch. The polishing pad 600 further includes an inner intermediate region 606 bounded by the inner imaginary line 604 and an intermediate imaginary line 608. The inner intermediate region 606 has a radial width $W_2$ of, for example, about 4.5 inches. The polishing pad 600 still further includes an outer intermediate region 612 bounded by the intermediate imaginary line 608 and the outer imaginary line 614. The outer intermediate region 612 has a radial width $W_3$ of, for example, about 1.5 inches.

The outermost region 620 includes a plurality of substantially circular grooves 622 concentric about a center 624 of the pad. The inner intermediate region 606 also includes a plurality of substantially circular concentric grooves 610. The innermost region 602 is free of grooves.

The outer intermediate region 612 includes a plurality of substantially circular concentric grooves 616 and a plurality of perforations 618. The perforations 618 may be of any shape independent of curvature about the center 624 of the polishing pad 600 (such as in the case of arcs defined herein). For example, the perforations may be circular or elliptical in shape. The perforations 618 may intersect or lie between the grooves 616.

The perforations 618 may be made simply by punching-out holes in the polishing pad. The perforations 618 advantageously reduce the polishing rate attributable to the outer intermediate region 612 while improving the distribution of polishing slurry over the polishing pad and at the substrate/pad interface. Still further, the perforations 618 facilitate removing the substrate from the pad's surface by reducing the surface tension between the substrate and the pad.

If circular, the perforations may have a radius of about 0.5 inches, and may be disposed in a distorted hexagonal array in the outer intermediate region 612. The grooves in the inner and outer intermediate regions may have a width of about 20 mils and a pitch of about 120 mils. The surface area available for polishing in the outer intermediate region 512 may be about 38% of the total surface area.

The polishing pad 600 advantageously attenuates, or lowers, the polishing rate attributable to the outer intermediate region 612. The polishing rate is lower in the outer intermediate region 612 because grooves 616 and perforations 618 reduce the surface area available for polishing. As such, the polishing pad 600 can overcome or substantially reduce the problems associated with the polishing rings, edge effect and edge-fast polishing.

The grooves of the embodiments described above provide air channels which reduce vacuums and adhesion-forming surface tensions between the polishing pad and the substrate. The perforations 618 also reduce such surface tensions. As the surface area available for polishing decreases, an accompanying increase in the polishing time may be required to achieve the same polishing results. The surface area of the pad available for polishing is the total cross-sectional surface area capable of being in contact with the substrate.

The grooves may be formed in the polishing surface by cutting or milling. Specifically, a saw blade on a mill may be used to cut grooves in the polishing surface. Alternatively, grooves may be formed by embossing or pressing the polishing surface with a hydraulic or pneumatic press. The relatively simple groove pattern avoids expensive machining. Also, the grooves may be formed by preparing the polishing pad in a mold. For example, the grooves may be formed during a polymerization reaction in which the polishing pad is cast from a mold which contains a negative image of the grooves.

As was described above, the slurry/rinse arm provides slurry to the polishing surface. The continuous channels formed in the polishing pad facilitate the migration of slurry around the polishing pad. Thus, excess slurry in any region of the pad may be transferred to another region by the groove structure providing more uniform coverage of slurry over the polishing surface. Accordingly, the distribution of slurry is improved and any variations in the polishing rate attributable to poor slurry distribution will be reduced.

In addition, the grooves reduce the possibility that waste materials generated during the polishing and conditioning cycles will interfere with slurry distribution. The grooves facilitate the migration of waste materials away from the polishing pad surface reducing the possibility of clogging. The width of the grooves permits a spray rinse from a slurry/rinse arm to effectively flush the waste materials from the grooves.

The depth of the grooves improves polishing pad lifetime. As discussed above, the conditioning process abrades and removes material from the surface of the polishing pad, thereby reducing the depth of the grooves. Consequently, the lifetime of the pad may be increased by increasing the groove depth.

The invention is not limited to the embodiment depicted and described. Rather, the scope of the invention is defined by the appended claims.

What is claimed is:

1. A polishing pad for polishing a substrate in a chemical mechanical polishing system, comprising:

a first polishing region having a first plurality of substantially circular concentric grooves with a first width and a first pitch; and a second polishing region surrounding the first polishing region and having a second plurality of substantially circular concentric grooves with a second width and a second pitch, wherein the second polishing region is an outermost concentric region of the polishing pad, and wherein the second pitch is less than the first pitch.

2. The polishing pad of claim 1, wherein the second width is greater than the first width.

3. The polishing pad of claim 1, wherein a first plurality of partitions separates the first plurality of grooves and a second plurality of partitions separates the second plurality of grooves.

4. The polishing pad of claim 3 wherein a ratio of the surface area of the first plurality of partitions to the surface area of the first polishing region is greater than a ratio of the surface area of the second plurality of partitions to the surface area of the second polishing region.

5. The polishing pad of claim 1, wherein the first width is substantially equal to the second width.

6. A polishing pad for polishing a substrate in a chemical mechanical polishing system, comprising:

a first polishing region having a first plurality of substantially circular concentric grooves with a first width and a first pitch;

a second polishing region surrounding the first polishing region and having a second plurality of substantially circular concentric grooves with a second width and a second pitch, wherein the first width is greater than the second width or the first pitch is less than the second pitch; and a third polishing region surrounding the second polishing region and having a third plurality of substantially circular concentric grooves with a third width and a third pitch, the third pitch and third width being substantially equal to the first pitch and first width, respectively.

7. The polishing pad of claim 6, wherein the first pitch is less than the second pitch.

8. The polishing pad of claim 7, wherein the first width is substantially equal to the second width.

9. The polishing pad of claim 6, wherein the first width is greater than the second width.

10. The polishing pad of claim 9, wherein the first pitch is substantially equal to the second pitch.

11. The polishing pad of claim 6, wherein a first plurality of partitions separate the first plurality of grooves, a second plurality of partitions separate the second plurality of grooves, and a third plurality of partitions separate the third plurality of grooves.

12. The polishing pad of claim 11, wherein a first ratio of the surface area of the first plurality of partitions to the surface area of the first region is in the range of about 0.5 to 0.75, a second ratio of the surface area of the second plurality of partitions to the surface area of the second region is in the range of about 0.75 to 0.95, and a third ratio of the surface area of the third plurality of partitions to the surface area of the third region is in the range of about 0.50 to 0.75.

13. The polishing pad of claim 12, wherein the first and third ratios are about 0.69; and wherein the second ratio is about 0.83.

14. The polishing pad of claim 6, wherein the first, second and third pluralities of grooves each have a depth in the range of about 0.02 to 0.03 inches.

15. The polishing pad of claim 6, wherein a ratio of the first width to the second width is in the range of about 2:1 to 20:1.

16. The polishing pad of claim 15, wherein the ratio of the first width to the second width is approximately 6:1.

* * * * *